US010654153B2

(12) United States Patent
Murakami et al.

(10) Patent No.: US 10,654,153 B2
(45) Date of Patent: May 19, 2020

(54) IMPACT TOOL

(71) Applicant: HITACHI KOKI CO., LTD., Tokyo (JP)

(72) Inventors: Takuhiro Murakami, Ibaraki (JP); Junichi Toukairin, Ibaraki (JP); Shota Takeuchi, Ibaraki (JP); Hironori Mashiko, Ibaraki (JP); Yuta Noguchi, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 235 days.

(21) Appl. No.: 15/546,893

(22) PCT Filed: Jan. 8, 2016

(86) PCT No.: PCT/JP2016/050502
§ 371 (c)(1),
(2) Date: Jul. 27, 2017

(87) PCT Pub. No.: WO2016/121462
PCT Pub. Date: Aug. 4, 2016

(65) Prior Publication Data

US 2018/0117745 A1 May 3, 2018

(30) Foreign Application Priority Data

Jan. 30, 2015 (JP) ..... 2015-017758
Jul. 15, 2015 (JP) ..... 2015-141594

(51) Int. Cl.
*B25D 11/04* (2006.01)
*B25B 21/02* (2006.01)
*B25D 11/10* (2006.01)

(52) U.S. Cl.
CPC ..... *B25B 21/02* (2013.01); *B25D 11/04* (2013.01); *B25D 11/104* (2013.01)

(58) Field of Classification Search
CPC ..... B25B 21/02; B25B 21/026; B25D 11/04; B25D 11/104; B25D 11/102
(Continued)

(56) References Cited

U.S. PATENT DOCUMENTS 3,741,314 A * 6/1973 Leoni ..... B25B 21/02 173/93.6
6,457,535 B1 10/2002 Tanaka
(Continued)

FOREIGN PATENT DOCUMENTS

CN 1891408 A 1/2007
JP S51-019200 B1 6/1976
(Continued)

OTHER PUBLICATIONS

Extended European Search Report issued in corresponding European Patent Application No. 16743066.9-1019, dated Jan. 15, 2019.
(Continued)

*Primary Examiner* — Chelsea E Stinson
*Assistant Examiner* — Himchan "Aiden" Song
(74) *Attorney, Agent, or Firm* — McDermott Will & Emery LLP

(57) ABSTRACT

In order to provide an impact tool which is capable of increasing a striking force in a rotational direction of being applied from a hammer to an anvil, the impact tool includes: an electric motor; an anvil which supports a work tool and is driven by the electric motor; and a hammer which applies the striking force in the rotational direction to the anvil. The impact tool is provided with: a spindle which is arranged to be concentric with the anvil, supports the hammer to be movable in an axial direction and the rotational direction with respect to the anvil, and transmits motive power of the electric motor to the anvil; and a control unit which controls rotation speed of the electric motor. The number of strokes
(Continued)

27 : ANVIL
40 : SPINDLE
43 : HAMMER of the anvil due to one rotation of the hammer differs in response to rotation speed of the electric motor.

9 Claims, 19 Drawing Sheets

(58) Field of Classification Search
USPC .. 173/5, 7, 48, 95, 104, 109, 201, 170, 171, 173/93, 93.5, 93.6, 176, 178
See application file for complete search history.

(56) References Cited

U.S. PATENT DOCUMENTS

| | | | | |
|---|---|---|---|---|
| 2007/0000676 | A1* | 1/2007 | Arimura | B25B 21/02 173/179 |
| 2009/0295313 | A1 | 12/2009 | Suzuki et al. | |
| 2013/0333910 | A1* | 12/2013 | Tanimoto | B25B 21/02 173/176 |
| 2015/0196997 | A1* | 7/2015 | McClung | B25D 9/06 173/93 |
| 2019/0255687 | A1* | 8/2019 | Schneider | B25D 11/04 |

FOREIGN PATENT DOCUMENTS

| | | | | |
|---|---|---|---|---|
| JP | S59-088264 | U | | 6/1984 |
| JP | S62-099086 | A | | 5/1987 |
| JP | H01-170570 | U | | 12/1989 |
| JP | H06-182674 | A | | 7/1994 |
| JP | H11-90845 | A | | 4/1999 |
| JP | 2000-317854 | A | | 11/2000 |
| JP | 2001-219383 | A | | 8/2001 |
| JP | 2003-220569 | A | | 8/2003 |
| JP | 2003220569 | A | * | 8/2003 |
| JP | 2009-285805 | A | | 12/2009 |

OTHER PUBLICATIONS

International Search Report issued in Application No. PCT/Jp2016/050502 dated Mar. 22, 2016, with English translation.
Chinese Office Action issued in corresponding Chinese Patent Application No. 201680007917.1, dated Jul. 27, 2018, with English Translation.

* cited by examiner

27 : ANVIL
40 : SPINDLE
43 : HAMMER (B)

FIG. 9

| MODE OF TACTILE SWITCH | HIGH-SPEED MODE | MEDIUM-SPEED MODE | LOW-SPEED MODE |
|---|---|---|---|
| RATED VOLTAGE | 18 | 18 | 18 |
| DUTY RATIO | 90～100 | 55～65 | 15～25 |
| TARGETED ROTATION SPEED | 23,000 | 14,000 | 4,000 |
| HAMMER INERTIA | 0.37 | 0.37 | 0.37 |
| LEAD ANGLE | 32.00 | 32.00 | 32.00 |
| SPRING CONSTANT | 33.54 | 33.54 | 33.54 |
| NUMBER OF STROKES [STROKE/ROTATION] | 1.5 | 3.0 | 3.0 |

(A)

(B)

IMPACT TOOL

RELATED APPLICATIONS

This application is the U.S. National Phase under 35 U.S.C. § 371 of International Application No. PCT/JP2016/050502, filed on Jan. 8, 2016, which in turn claims the benefit of Japanese Application No. 2015-017758, filed on Jan. 30, 2015, and Japanese Application No. 2015-141594, filed on Jul. 15, 2015, the disclosures of which are incorporated by reference herein.

TECHNICAL FIELD

The present invention relates to an impact tool which applies a rotational-direction striking force to a tool support member by using a hammer.

BACKGROUND ART

Conventionally, an impact tool, which transmits a rotational force of a motor to a hammer and applies a striking force in a rotational direction to a tool support member using the hammer, has been known, and such an impact tool is described in Patent Document 1. The impact tool described in Patent Document 1 includes: a housing; a motor provided inside the housing; a spindle to which a rotational force of the motor is transmitted; a first cam groove provided in an outer circumferential surface of the spindle; a cylindrical hammer attached to an outer circumference of the spindle; a first engaging portion provided in the hammer; a second cam groove provided in an inner circumferential surface of the hammer; a cam ball held by the first cam groove and the second cam groove; a tool support member rotatably supported by the housing; a second engaging portion provided in the tool support member; and a spring as an elastic member which presses the hammer toward the tool support member. A tightening tool is attached to the tool support member. The tightening tool is provided with a concave portion that a head portion of a screw member enters.

When a rotational force of the motor is transmitted to the spindle, the rotational force is transmitted to the hammer via the cam ball and transmitted to the tool support member via the first engaging portion and the second engaging portion, thereby tightening the screw member. When a rotational force required to tighten the screw member is small, the hammer does not move in an axial direction of the spindle and the first engaging portion does not climb over the second engaging portion.

On the contrary, when the rotational force required to tighten the screw member increases, the hammer moves in the axial direction of the spindle and in a direction of separating from the tool support member against a force of the elastic member, and the first engaging portion climbs over the second engaging portion. Then, the hammer moves in the axial direction of the spindle and in a direction of approaching the tool support member by the force of the elastic member, and the first engaging portion strikes the second engaging portion. In this manner, a striking force in the rotational direction is applied from the hammer to the tool support member.

RELATED ART DOCUMENTS

Patent Document

Patent Document 1: Japanese Patent Application Laid-open No. 59-88264

SUMMARY OF THE INVENTION

Problems to be Solved by the Invention

In the above-described impact tool descried in Patent Document 1, however, the striking force in the rotational direction applied from the hammer to the tool support member is insufficient in some cases, and there is still room for improvement. For example, the impact tool described in Patent Document 1, it is necessary to increase a spring constant or the like of the elastic member in order to increase the striking force. If so, a torque required to detach the first engaging portion from the second engaging portion is eventually increased, which causes a problem of making screw tightening work difficult.

An object of the present invention is to provide an impact tool which is capable of increasing a striking force in a rotational direction to be applied from a hammer to a tool support member. In addition, the present invention aims to provide the impact tool which is capable of increasing the striking force without increasing a torque required to detach a first engaging portion from a second engaging portion. Further, the present invention aims to provide the impact tool which is capable of speeding up tightening of the screw member.

Means for Solving the Problems

An impact tool according to one embodiment comprises: a motor; a tool support member which supports a work tool and is driven by the motor; and a hammer which applies a striking force in a rotational direction to the tool support member, in which the impact tool is provided with: a rotating member which is arranged to be concentric with the tool support member, supports the hammer to be movable in an axial direction and the rotational direction with respect to the tool support member, and transmits motive power of the motor to the tool support member; and a control unit which controls rotation speed of the rotating member, and a number of strokes of the tool support member due to one rotation of the hammer differs in response to the rotation speed of the rotating member.

An impact tool according to another embodiment comprises: a motor; a tool support member which is driven by the motor and supports a work tool; and a hammer which applies a striking force in a rotational direction to the tool support member, in which the impact tool is provided with: a rotating member which is arranged to be concentric with the tool support member, supports the hammer to be movable in an axial direction and the rotational direction with respect to the tool support member, and transmits motive power of the motor to the tool support member; and a control unit which controls rotation speed of the rotating member, and the hammer has, in response to the rotation speed of the rotating member, different rotation angles between a first position at which the hammer strikes the tool support member and a second position at which the hammer strikes the tool support member after moving in the axial direction and rotating by a predetermined angle.

An impact tool according to another embodiment comprises: a motor; a tool support member which is driven by the motor and supports a work tool; and a hammer which applies a striking force in a rotational direction to the tool support member, in which the impact tool is provided with: a rotating member which is arranged to be concentric with the tool support member, supports the hammer to be movable in an axial direction and the rotational direction with respect to the tool support member, and transmits motive power of the motor to the tool support member; and a control unit which controls rotation speed of the rotating member, the hammer includes a plurality of first engaging portions which are mutually arranged at an equal angle in the rotational direction, the tool support member includes a plurality of second engaging portions which are mutually arranged at an equal angle in the rotational direction and are struck separately by the plurality of first engaging portion, and in response to the rotation speed of the rotating member, the hammer has: a first state where the hammer moves in the axial direction with respect to the tool support member and rotates by a predetermined angle so that one of the first engaging portions overpasses one of the second engaging portions, and then the hammer moves in the axial direction and strikes another of the second engaging portions; and a second state where the hammer moves in the axial direction with respect to the tool support member and rotates by a predetermined angle so that one of the first engaging portions overpasses two of the second engaging portions, and then the hammer moves in the axial direction and strikes yet another of the second engaging portions.

An impact tool according to another embodiment comprises: a tool support member which supports a work tool; and a hammer which applies a striking force in a rotational direction to the tool support member, in which the impact tool is provided with: a motor which transmits a rotational force to the tool support member; a rotating member which is arranged to be concentric with the tool support member, supports the hammer to be movable in an axial direction and the rotational direction with respect to the tool support member, and transmits motive power of the motor to the tool support member; a rotation speed setting mechanism which is operated by a worker to set rotation speed of the motor; and a control unit which controls the rotation speed of the motor in response to an operation of the rotation speed setting mechanism, the hammer strikes, in response to the rotation speed of the motor, the tool support member a predetermined number of times while the hammer rotates once when first rotation speed is set as the rotation speed of the motor, and a number of strokes of the tool support member due to one rotation of the hammer is smaller than the predetermined number of times when second rotation speed higher than the first rotation speed is set as the rotation speed of the motor.

An impact tool according to another embodiment comprises: a motor; a tool support member which supports a work tool and is driven by the motor; and a hammer which applies a striking force in a rotational direction to the tool support member, in which the impact tool is provided with: a rotating member which is arranged to be concentric with the tool support member, supports the hammer to be movable in an axial direction and the rotational direction with respect to the tool support member, and transmits motive power of the motor to the tool support member; three first engaging portions which are provided in the hammer and are mutually arranged at an equal angle in the rotational direction; three second engaging portions which are provided in the tool support member and are mutually arranged at an equal angle in the rotational direction; and a control unit which controls rotation speed of the rotating member so that the first engaging portions strike the second engaging portions 1.5 times while the hammer rotates once.

An impact tool according to another embodiment comprises: a motor; a tool support member which supports a work tool and is driven by the motor; and a hammer which applies a striking force in a rotational direction to the tool support member, in which the impact tool is provided with: a rotating member which is arranged to be concentric with the tool support member, supports the hammer to be movable in an axial direction and the rotational direction with respect to the tool support member, and transmits motive power of the motor to the tool support member; three first engaging portions which are provided in the hammer and are mutually arranged at an equal angle in the rotational direction; three second engaging portions which are provided in the tool support member and are mutually arranged at an equal angle in the rotational direction; and a control unit which controls rotation speed of the rotating member so that the first engaging portions strike the second engaging portions 3 times while the hammer rotates once.

An impact tool according to another embodiment comprises: a motor; a tool support member which supports a work tool and is driven by the motor; and a hammer which applies a striking force in a rotational direction to the tool support member, in which the impact tool is provided with: a rotating member which is arranged to be concentric with the tool support member, supports the hammer to be movable in an axial direction and the rotational direction with respect to the tool support member, and transmits motive power of the motor to the tool support member; and a control unit which changes a number of strokes of the tool support member due to one rotation of the hammer.

An impact tool according to another embodiment comprising: an electric motor; a tool support member which supports a work tool and is driven by the electric motor; and a hammer which applies a striking force in a rotational direction to the tool support member, in which the impact tool includes: a rotating member which is arranged to be concentric with the tool support member, supports the hammer to be movable in an axial direction and the rotational direction with respect to the tool support member, and transmits motive power of the electric motor to the tool support member; and a control unit which increases a voltage applied to the electric motor to increase rotation speed of the rotating member after the hammer strikes the tool support member a plurality of times.

Effects of the Invention

According to an impact tool of an embodiment, it is possible to increase the striking force in the rotational direction to be applied from the hammer to the tool support member. In addition, it is possible to speed up the tightening of the screw member.

BRIEF DESCRIPTIONS OF THE DRAWINGS

FIG. 9 is a table illustrating specifications of components and control examples of the impact tool;

Figure 13:
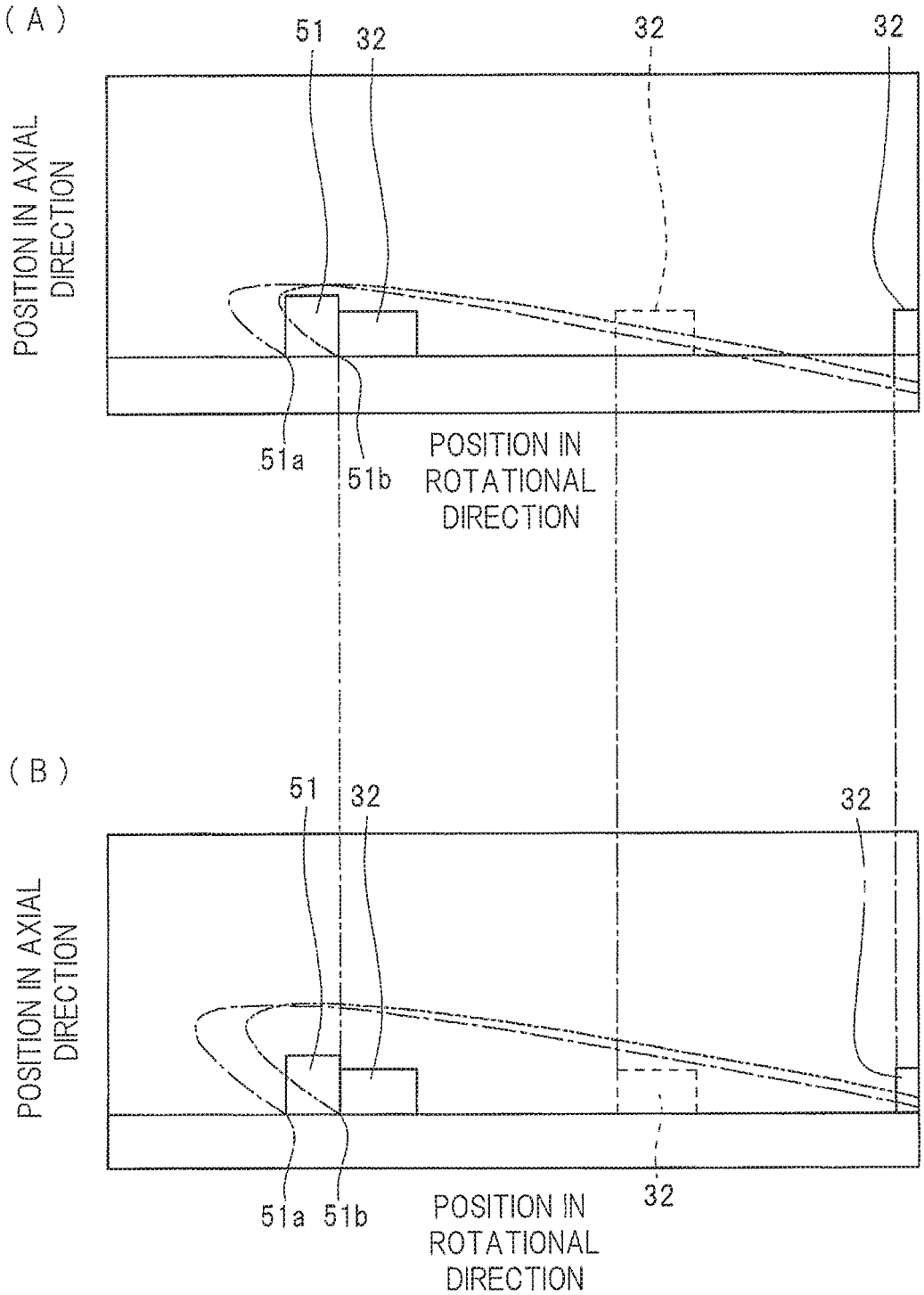
Figure 14:
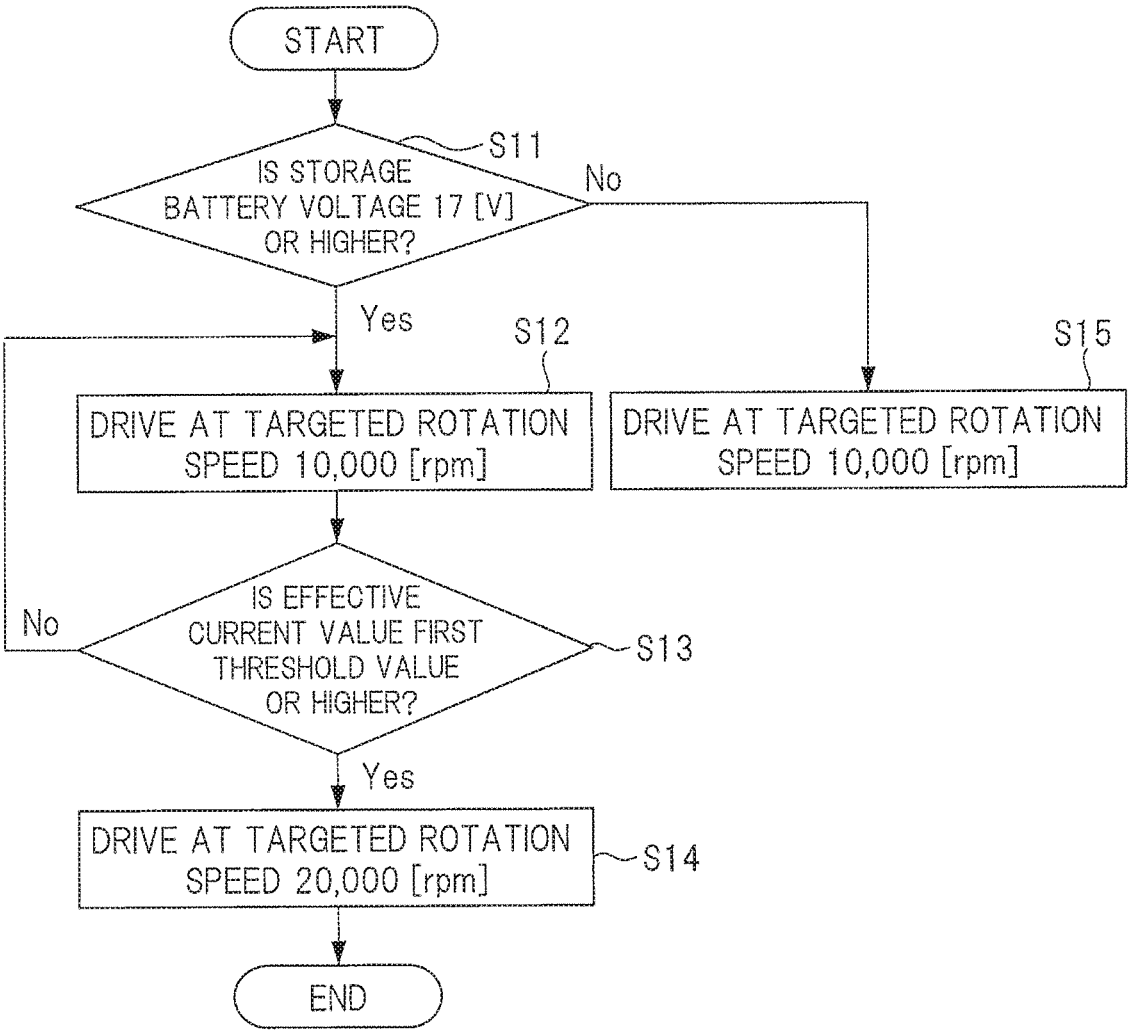
Figure 15:
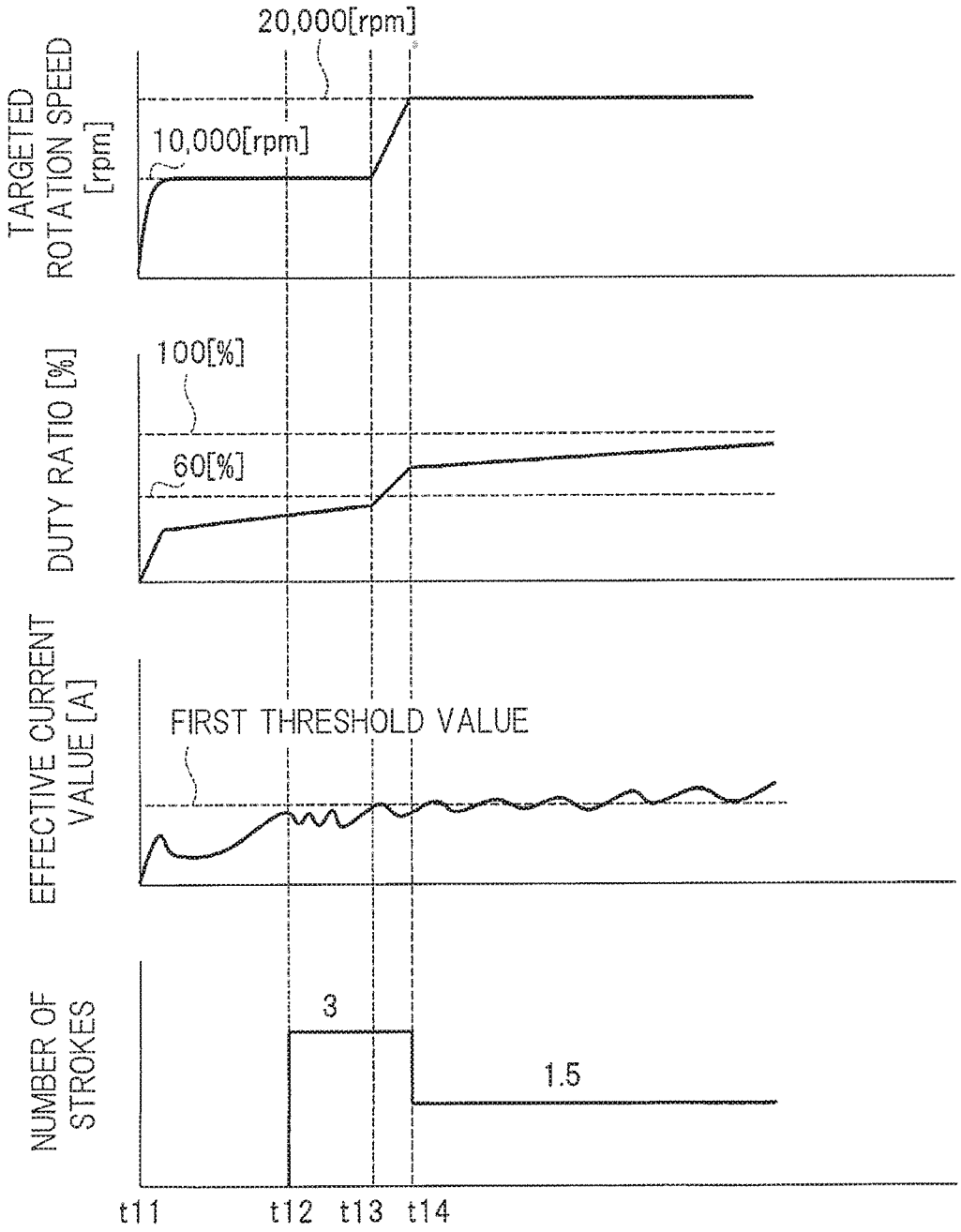
Figure 16:
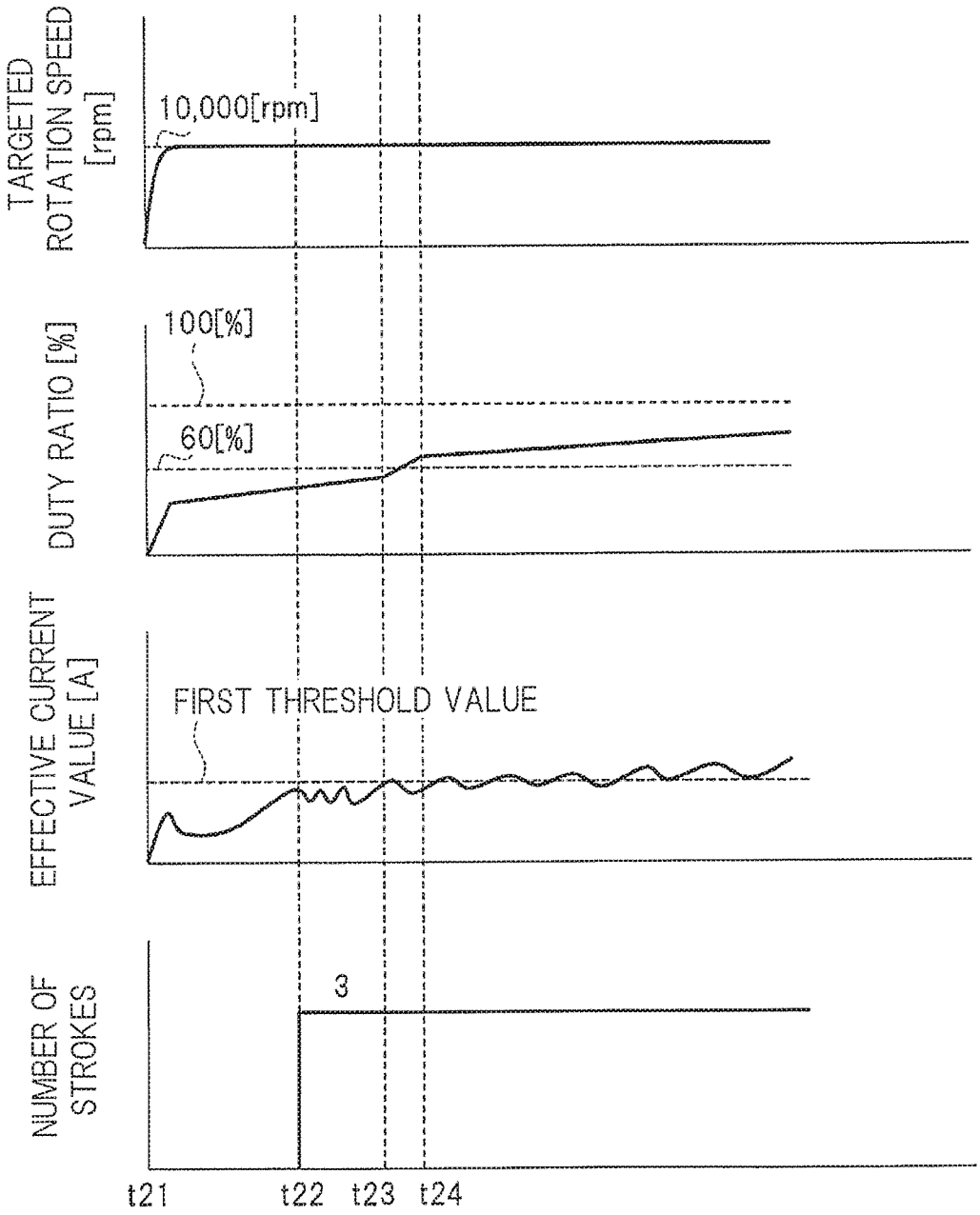
Figure 17:
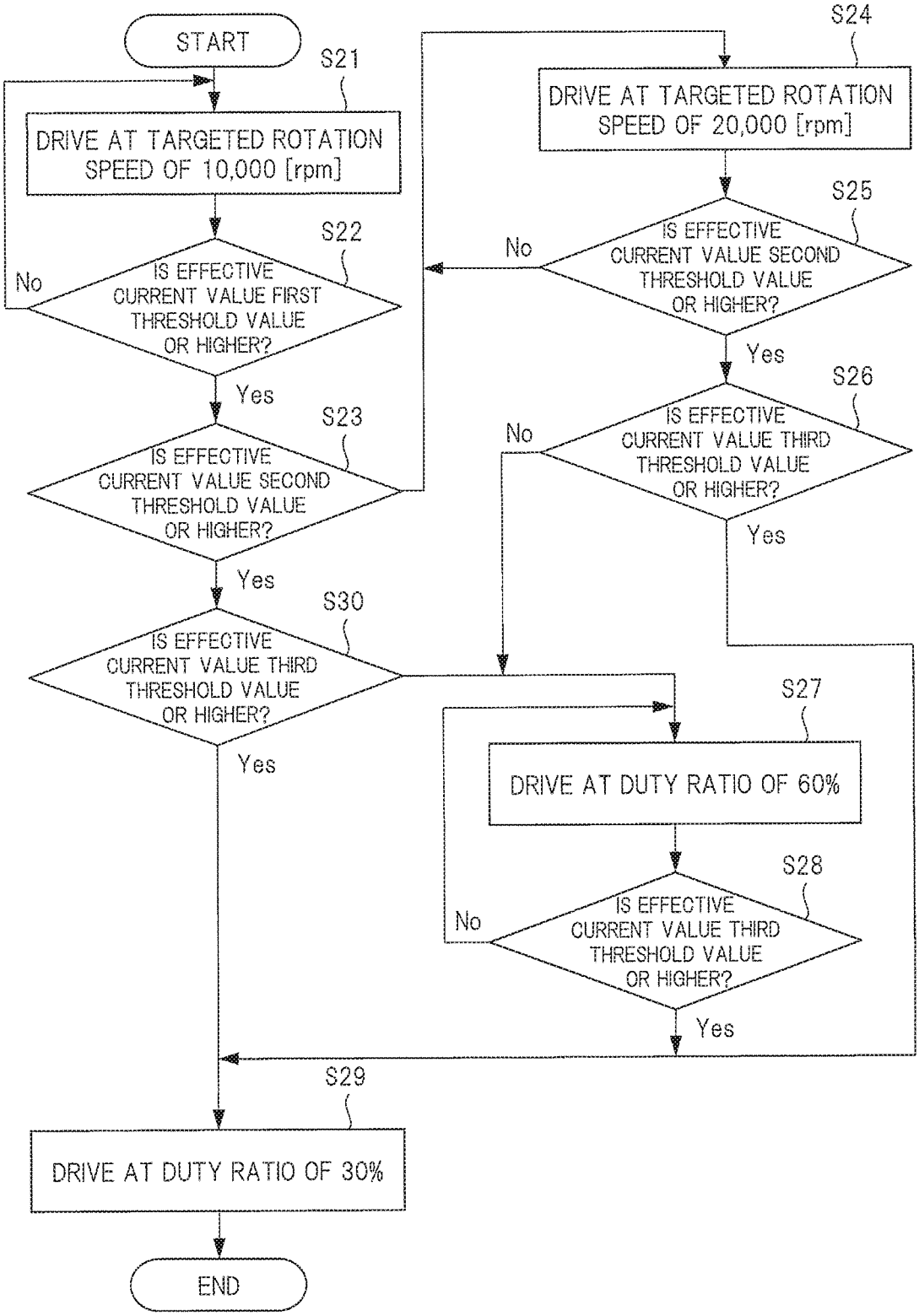
Figure 18:
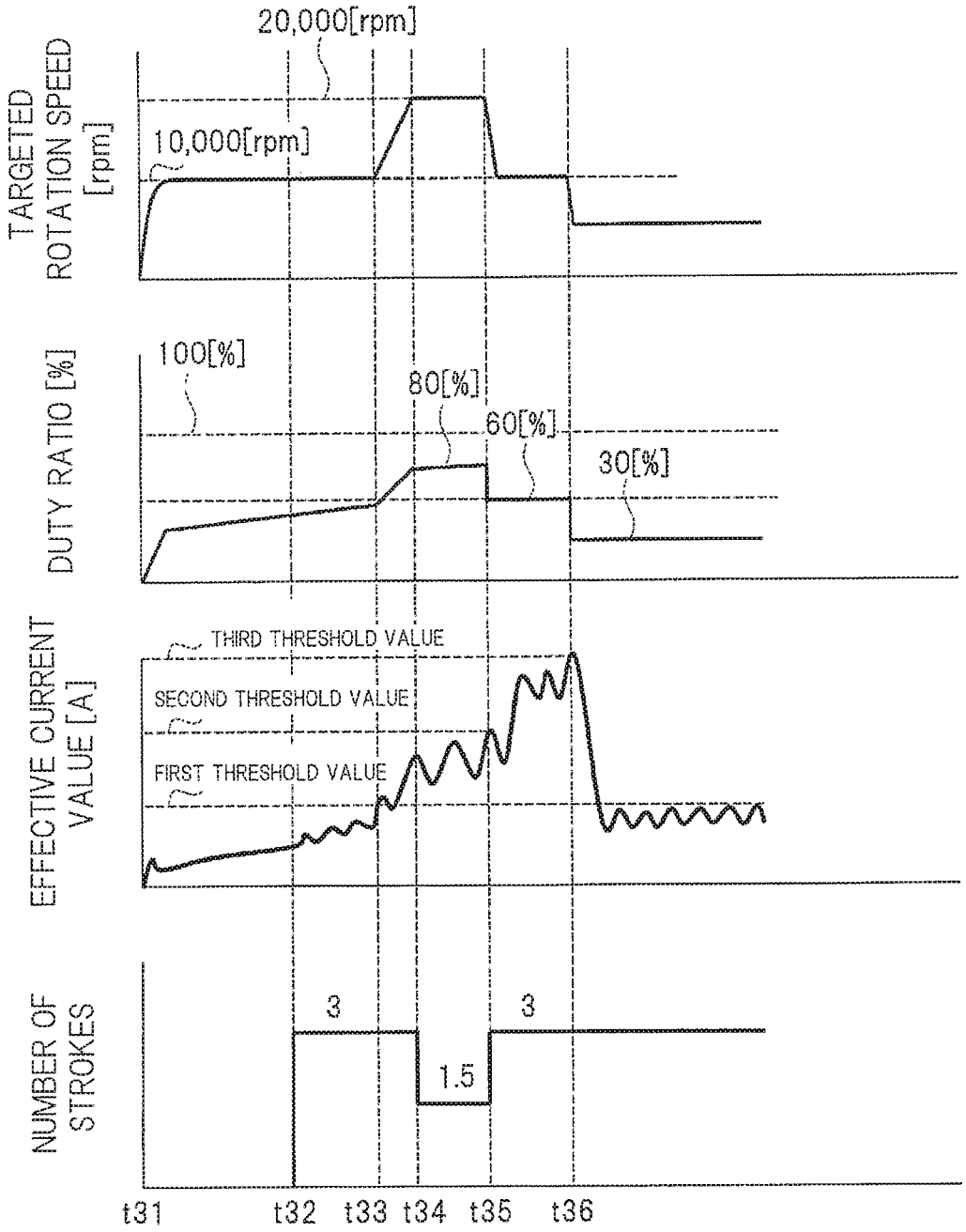
Figure 19:
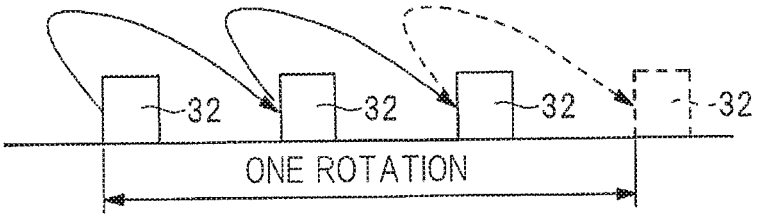
Figure 19:
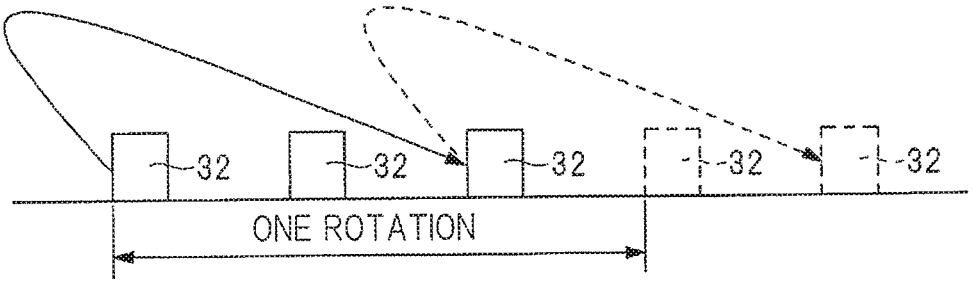

FIGS. 13(A) and 13(B) are schematic diagrams illustrating an operation of a protrusion of the hammer, the portion striking a protrusion of the anvil;

FIG. 14 is a flowchart according to Control Example 2 which can be executed by the impact tool according to the present invention;

FIG. 15 is a time chart which corresponds to Control Example 2 of FIG. 14;

FIG. 16 is a time chart which corresponds to Control Example 2 of FIG. 14;

FIG. 17 is a flowchart according to Control Example 3 which can be executed by the impact tool according to the present invention;

FIG. 18 is a time chart which corresponds to Control Example 3 of FIG. 17; and FIG. 19(A) is a trajectory of a case where the hammer strikes the protrusion three times while performing one rotation, and FIG. 19(B) is a trajectory of a case where the hammer strikes the protrusion 1.5 times while performing one rotation.

DETAILED DESCRIPTION OF PREFERRED EMBODIMENTS

Hereinafter, an embodiment of the present invention will be described in detail with reference to the drawings.

Figure 1:
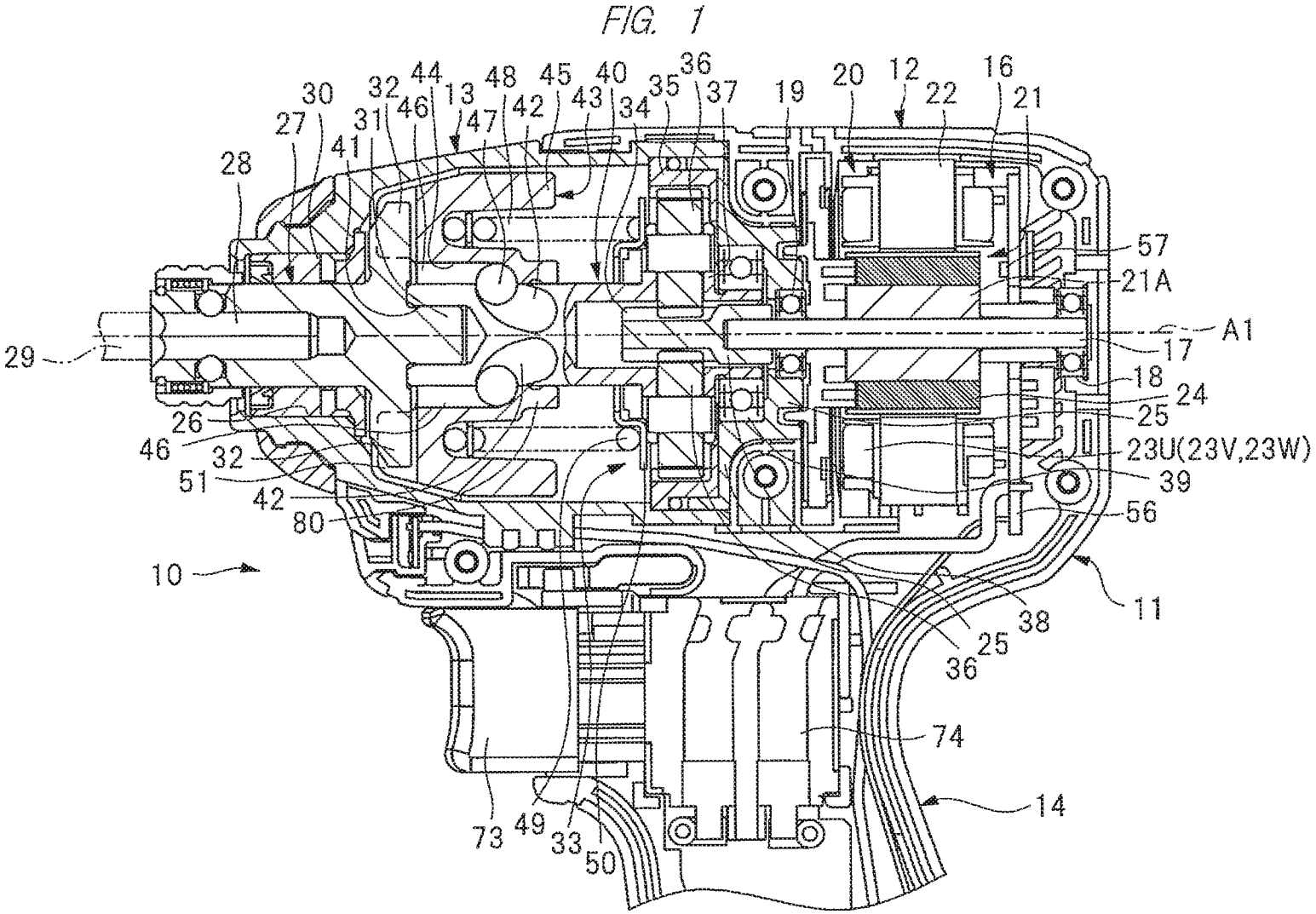
FIG. 1 is a front sectional view illustrating an internal structure of a housing of an impact tool according to the present invention.
Figure 2:
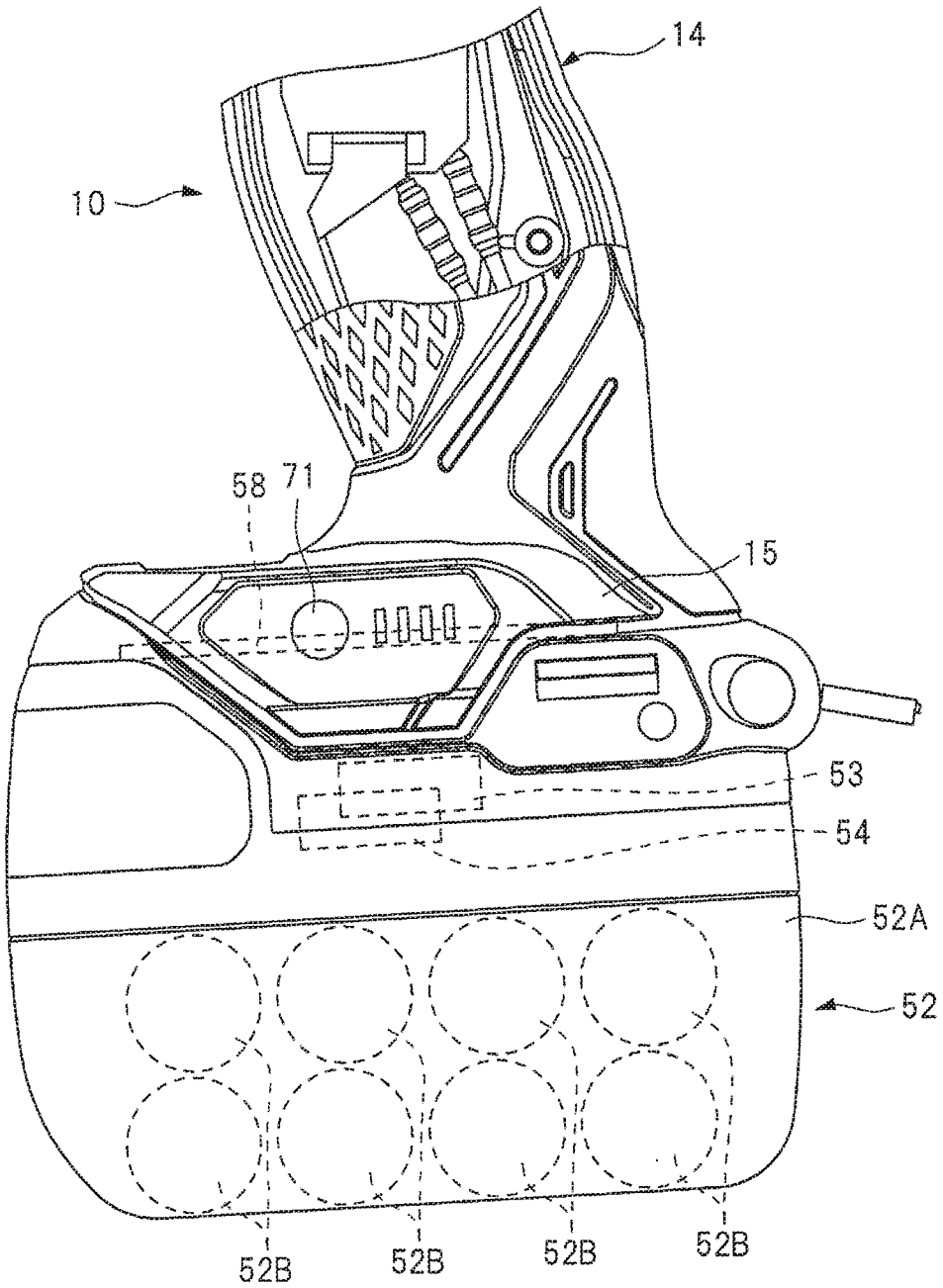
FIG. 2 is a partial front view in which a storage battery is attached to the impact tool according to the present invention.

An impact tool 10 illustrated in FIGS. 1 and 2 is an impact driver that is used for work of rotating a screw member to be tightened against and fixed to wood or concrete as a mating member and work of loosening the screw member. The impact tool 10 includes a hollow housing 11, and the housing 11 includes a motor case 12, and a grip 14 continuous with the motor case 12. A hammer case 13 is fixed to the motor case 12, and a mounting portion 15 is provided in the grip 14.

An electric motor 16 is provided inside the motor case 12. The electric motor 16 includes a stator 20 as an armature, and a rotor 21 as a field magnet. The stator 20 is provided inside the motor case 12 so as not to rotate, and the stator 20 includes a stator core 22, and three coils 23U, 23V and 23W which are wound around the stator core 22 and to which a current is supplied.

The rotor 21 includes an output shaft 17, a rotor core 21A which is fixed to the output shaft 17, and a plurality of permanent magnets 24 which are arranged along a rotational direction of the rotor core 21A. The output shaft 17 is rotatably supported by two bearings 18 and 19. When the current is supplied to the three coils 23U, 23V and 23W, a rotating magnetic field is formed, and thereby the rotor 21 rotates. The plurality of permanent magnets 24 are arranged by alternately arranging the permanent magnets 24 having different polarities along the rotational direction. The electric motor 16 is a brushless electric motor using no brush to which a current flows, and the electric motor 16 can switch the rotational direction of the rotor 21 by switching the direction of each current supplied to the three coils 23U, 23V and 23W.

A barrier wall 25, which partitions an interior of the motor case 12 and an interior of the hammer case 13, is provided inside the housing 11. The barrier wall 25 is attached so as not to rotate with respect to the housing 11. The barrier wall 25 supports the bearing 19, and the motor case 12 supports the bearing 18. The rotor 21 can rotate about an axis A1.

The annular hammer case 13 includes a shaft hole 26, and an anvil 27, which is rotatably supported by a cylindrical sleeve 30, is arranged at the shaft hole 26. The anvil 27 is made of metal and can rotate about the axis A1. In addition, the anvil 27 is provided to cross an exterior of the motor case 12 from the interior of the hammer case 13, and a tool holding hole 28 is provided in the anvil 27. The tool holding hole 28 is opened outside the motor case 12. A driver bit 29 serving as a work tool is attached to and detached from the tool holding hole 28.

Figure 3:
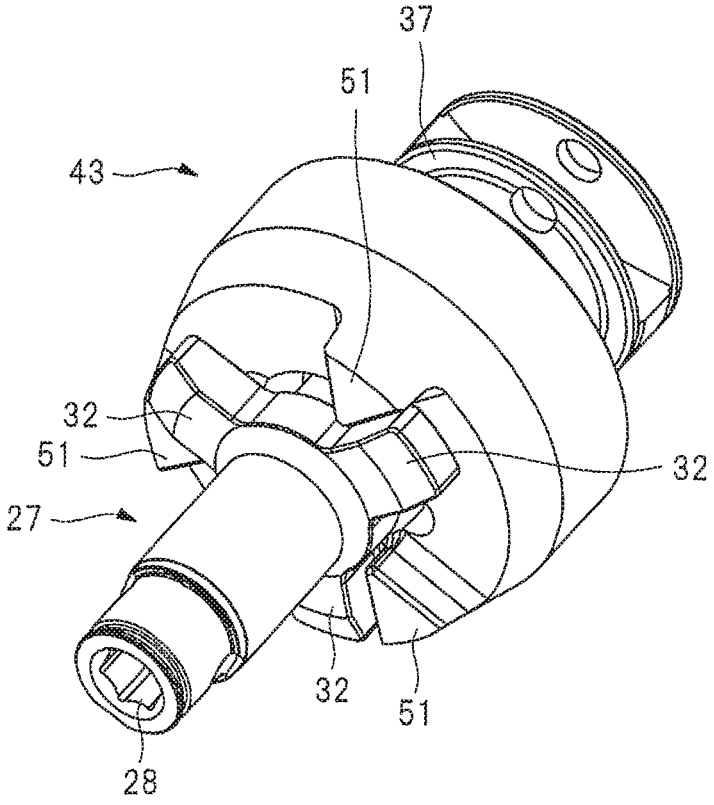
FIG. 3 is a perspective view illustrating an assembled state of a spindle, a hammer, and an anvil which are used in the impact tool of FIG. 1.
Figure 4:
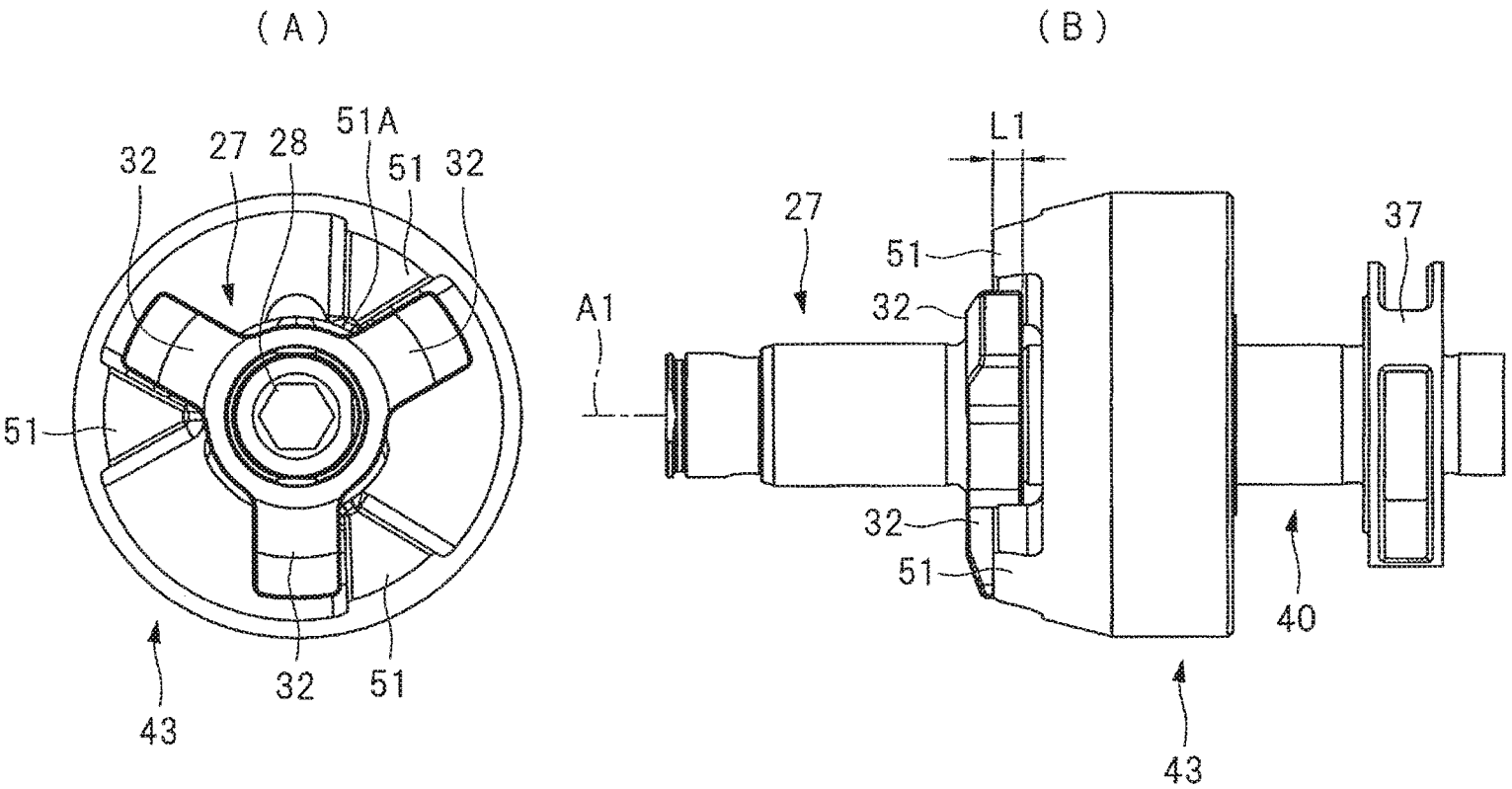
FIG. 4(A) is a side view of the hammer and the anvil which are used in the impact tool of FIG. 1.
FIG. 4(B) is a front view of the spindle, the hammer, and the anvil.
Figure 5:
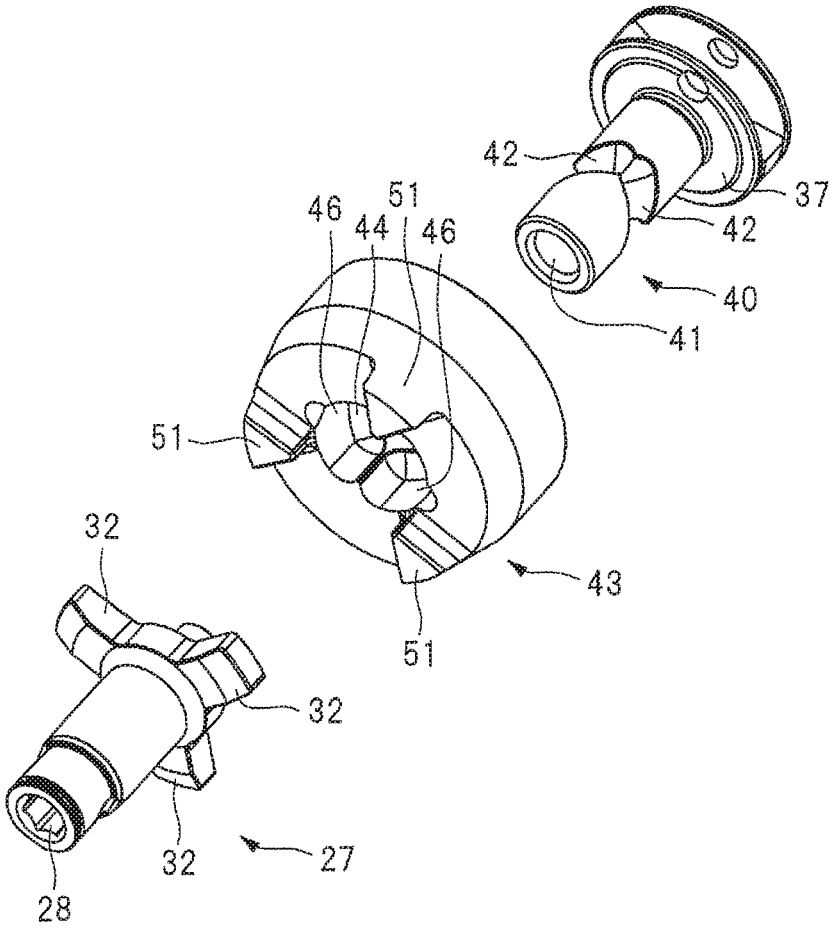
FIG. 5 is an exploded perspective view of the spindle, the hammer, and the anvil illustrated in FIG. 3.

In addition, a support shaft 31 is provided in the anvil 27 to be concentric with the tool holding hole 28. The support shaft 31 is arranged inside the hammer case 13. Further, a plurality of protrusions 32 are provided at locations arranged inside the hammer case 13 on an outer circumferential surface of the anvil 27. To be specific, the three protrusions 32 are arranged at an interval of an equal angle in a rotational direction of the anvil 27, that is, an interval of 120 degrees. The three protrusions 32 protrude from the outer circumferential surface of the anvil 27 to a radial direction thereof as illustrated in FIGS. 3 to 5. The three protrusions 32 include a first side surface and a second side surface which are parallel to each other. The first side surface and the second side surface are arranged along the radial direction of the anvil 27. A width of a single body as the protrusion 32 in the rotational direction of the anvil 27 is constant in the radial direction of the anvil 27.

Meanwhile, a decelerator 33 is provided inside the hammer case 13. The decelerator 33 is arranged between the bearing 19 and the anvil 27 in a direction along the axis A1. The decelerator 33 is a power transmission device that transmits a rotational force of the electric motor 16 to the anvil 27, and the decelerator 33 is configured using a so-called single-pinion planetary gear mechanism.

Figure 6:
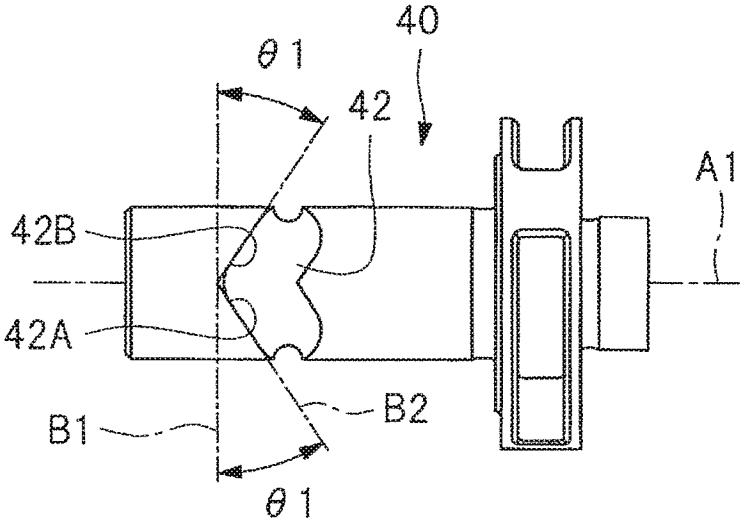
FIG. 6(A) is a side view of the spindle illustrated in FIG. 5.
FIG. 6(B) is a front view of the spindle illustrated in FIG. 5.
Figure 6:
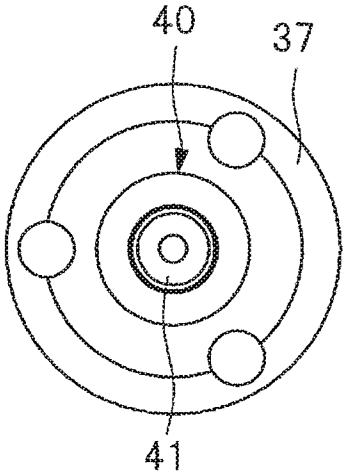

The decelerator 33 includes: a sun gear 34 which is arranged to be concentric with the output shaft 17; a ring gear 35 provided so as to surround an outer circumference side of the sun gear 34; and a carrier 37 which rotatably and revolvably supports a plurality of pinion gears 36 each meshed with the sun gear 34 and the ring gear 35. The sun gear 34 is formed on an outer circumferential surface of an intermediate shaft 38, and the intermediate shaft 38 rotates integrally with the output shaft 17. The ring gear 35 is fixed to the barrier wall 25 and does not rotate. The carrier 37 is rotatably supported by the bearing 39. The bearing 39 is supported by the barrier wall 25. The carrier 37 has an annular shape as illustrated in FIGS. 6(A) and 6(B).

In addition, a spindle 40, which rotates integrally with the carrier 37 about the axis A1, is provided inside the hammer case 13. The spindle 40 is made of metal and is arranged between the anvil 27 and the bearing 39 in the direction along the axis A1. A support hole 41 is formed at an end portion of the spindle 40 in the axis A1 direction. The support shaft 31 is inserted into the support hole 41, and the spindle 40 and the anvil 27 are relatively rotatable. Two V-shaped cam grooves 42 are provided in an outer circumferential surface of the spindle 40. The cam grooves 42 include inclined edges 42A and 42B, and the two inclined edges 42A and 42B are formed to be convex toward the anvil 27. A lead angle θ1 on an acute angle side is formed between the inclined edge 42A and a straight line B1. The lead angle θ1 on the acute angle side is formed between the inclined edge 42B and the straight line B1. The straight line B1 intersects the axis A1, that is, has a right angle with respect to the axis A1.

In addition, a hammer 43 made of metal is contained inside the hammer case 13. The hammer 43 has an annular shape and includes a shaft hole 44. The spindle 40 is arranged in the shaft hole 44. The hammer 43 is arranged between the decelerator 33 and the anvil 27 in the direction along the axis A1. The hammer 43 is rotatable with respect to the spindle 40 and is movable in the direction along the axis A1.

Figure 7:
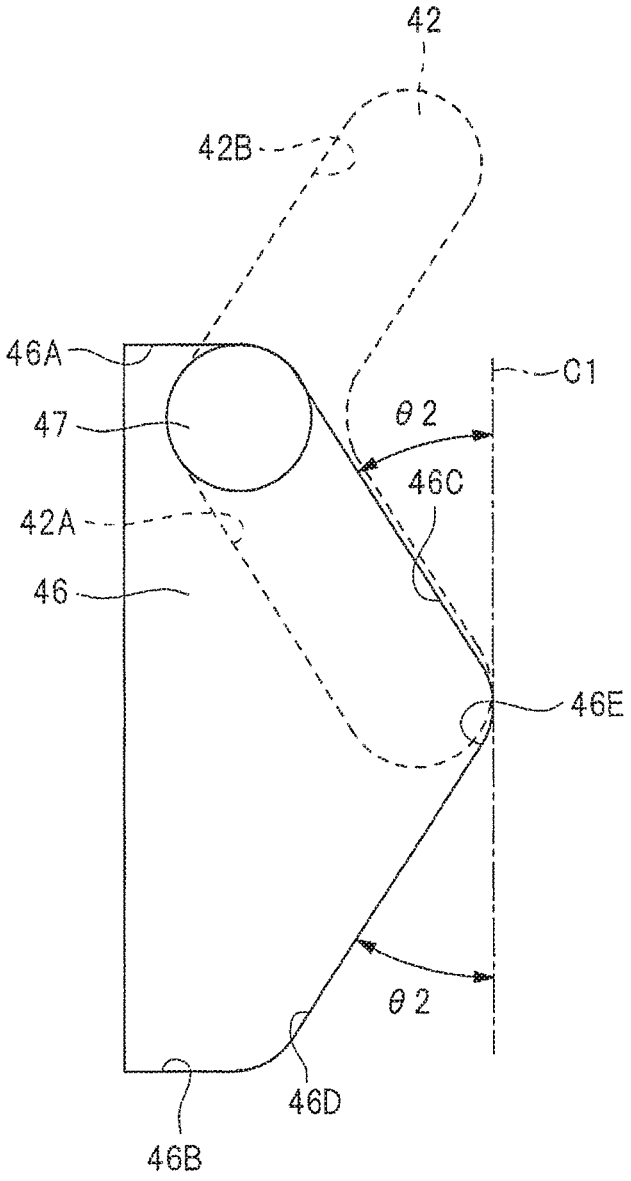
FIG. 7 is a developed view illustrating a cam groove provided in the spindle and a cam groove provided in the hammer.

The hammer 43 includes an outer cylindrical portion 45 and an inner cylindrical portion 80, and the outer cylindrical portion 45 is arranged outside the inner cylindrical portion 80. Two cam grooves 46 are formed in an inner circumferential surface of the inner cylindrical portion 80. The two cam grooves 46 are arranged mutually in different ranges in a circumferential direction of the hammer 43. The cam groove 46 has a triangular shape as illustrated in FIG. 7, and the cam groove 46 includes: side edges 46A and 46B, which extend in the direction along the axis A1 and are parallel to each other; an inclined edge 46C connected to the side edge 46A; and an inclined edge 46D connected to the side edge 46B. Further, the inclined edge 46C and the inclined edge 46D are connected to each other via a curved portion 46E. The curved portion 46E is convex in a direction of separating from the anvil 27. A lead angle θ2 on an acute angle side is set between the straight line C1 and the inclined edge 46C. The lead angle θ2 of the acute angle side is set between the straight line C1 and the inclined edge 46D. The lead angle θ1 and the lead angle θ2 have the same value. The straight line C1 intersects the axis A1, and has a right angle with respect to the axis A1.

Further, one cam ball 47 is held using the single cam groove 42 and the single cam groove 46 as a set. Thus, the hammer 43 is movable in the direction along the axis A1 with respect to the spindle 40 and the anvil 27 within a range in which the cam ball 47 can roll. In addition, the hammer 43 is rotatable with respect to the spindle 40 within the range in which the cam ball 47 can roll.

Further, the hammer 43 includes a holding groove 48 which is formed between the outer cylindrical portion 45 and the inner cylindrical portion 80. The holding groove 48 is opened toward the decelerator 33. The holding groove 48 is provided in an annular shape along the axis A1 as a center thereof. Further, a hammer spring 49 is arranged in the holding groove 48. The hammer spring 49 is made of metal, and generates a repulsive force when receiving a compression load. In addition, an annular plate 50 is attached to the carrier 37, and an end portion of the hammer spring 49 contacts the plate 50. The hammer spring 49 is arranged between the plate 50 and the hammer 43 in a state where a load in the direction along the axis A1 is applied. A pressing force of the hammer spring 49 is applied to the hammer 43, and the hammer 43 is pushed in the direction along the axis A1 and in a direction of approaching the anvil 27.

Further, a plurality of protrusions 51, which protrude in the direction along the axis A1, are provided at an end portion of the hammer 43 on the anvil 27 side. The three protrusions 51 are provided with an interval of an equal angle in a rotational direction of the hammer 43. That is, the three protrusions 51 are mutually arranged with an interval of 120 degrees therebetween. A range in which the three protrusions 51 are arranged in the radial direction of the hammer 43 overlaps a ranged in which the three protrusions 32 are arranged. Each of the three protrusions 51 has a triangular shape when viewed from an end surface of the hammer 43, and any of their vertexes 51A is arranged at each inner circumferential end of the protrusions 51. That is, each of the protrusions 51 includes a first side surface and a second side surface which correspond to two sides of a triangle.

Figure 8:
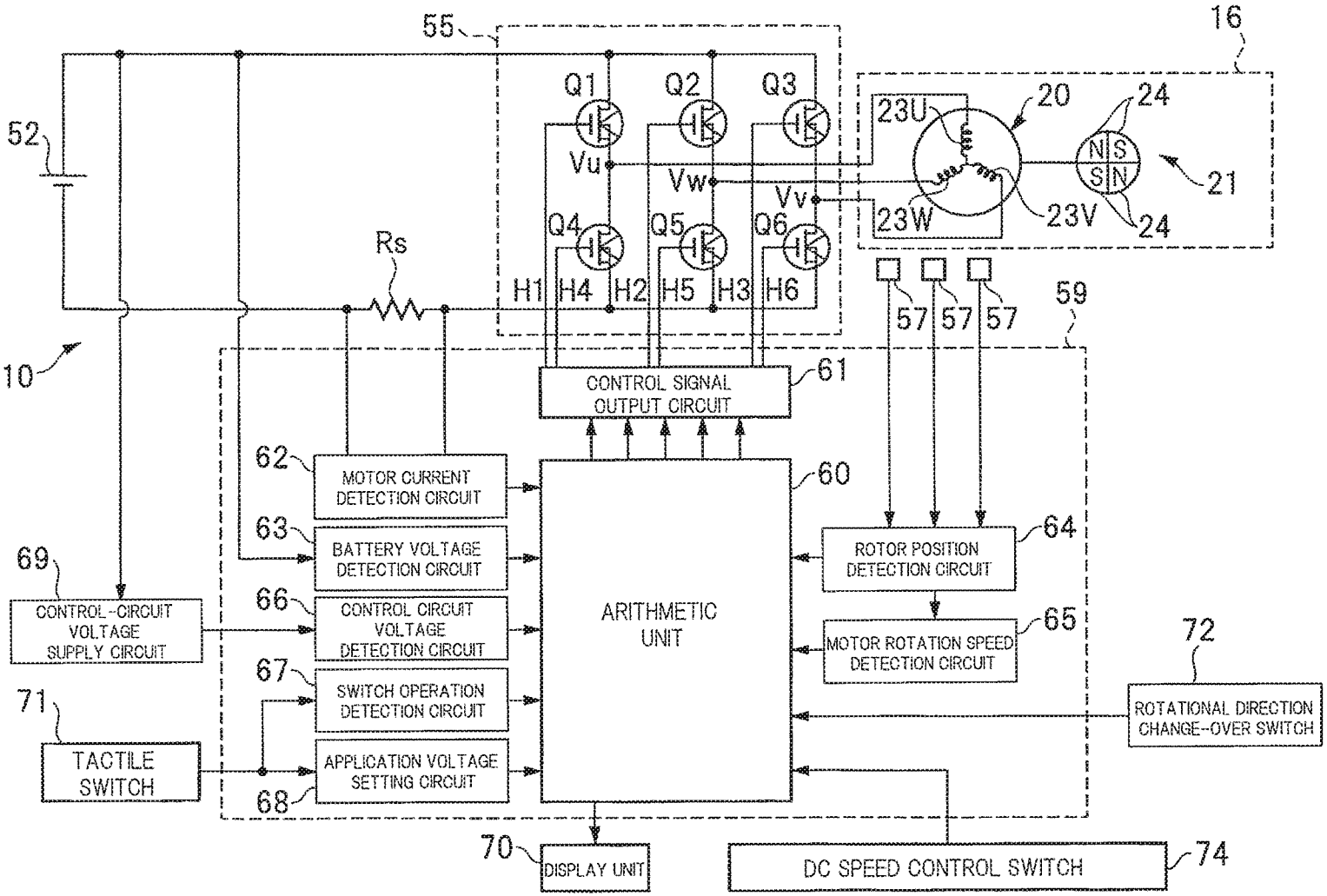
FIG. 8 is a block diagram illustrating a control system of the impact tool according to the present invention.

Next, a control system of the electric motor 16 in the impact tool 10 will be described with reference to FIGS. 1, 2, and 8. A storage battery 52 to be attached to and detached from the mounting portion 15 is provided. A body-side terminal 53 is provided in the mounting portion 15. The storage battery 52 includes a containing case 52A, and a plurality of battery cells 52B which are contained in the containing case 52A. The battery cell 52B is a secondary battery which can be changed and discharged, and a lithium ion battery, a nickel-metal hybrid battery, a lithium ion polymer battery, and a nickel-cadmium battery can be used as the battery cell 52B. The storage battery 52 is a direct current (DC) power supply. The storage battery 52 includes a battery-side terminal 54 which is connected to an electrode of the battery cell 52B, and the body-side terminal 53 and the battery-side terminal 54 are connected to each other when the storage battery 52 is attached to the mounting portion 15.

An inverter circuit 55 is provided in a path which supplies a current of the storage battery 52 to the electric motor 16. The inverter circuit 55 includes six switching elements Q1 to Q6 configured by field effect transistors (FET) connected in a three-phase bridge format. Each of the switching elements Q1 to Q3 is connected to a positive electrode side of the storage battery 52, and each of the switching elements Q4 to Q6 is connected to a negative electrode side of the storage battery 52. An inverter circuit board 56 is provided between the bearing 18 and the electric motor 16, and the inverter circuit 55 is provided on the inverter circuit board 56.

In addition, a rotor position detection sensor 57, which detects a rotation position of the rotor 21, is provided in the inverter circuit board 56. The rotor position detection sensor 57 is configured by a Hall IC, and the three rotor position detection sensors 57 are arranged with respect to the inverter circuit board 56 every predetermined interval in the rotational direction of the rotor 21, for example, every angle of 60 degrees. Each of the three rotor position detection sensors 57 detects a magnetic field which is formed by the permanent magnet 24, and outputs a signal in response to a detection result.

In addition, a control circuit board 58 is provided inside the mounting portion 15. A motor control unit 59 is provided in the control circuit board 58. The motor control unit 59 includes an arithmetic unit 60, a control signal output circuit 61, a motor current detection circuit 62, a battery voltage detection circuit 63, a rotor position detection circuit 64, a motor rotation speed detection circuit 65, a control-circuit voltage detection circuit 66, a switch operation detection circuit 67, and an application voltage setting circuit 68.

A signal outputted from the rotor position detection sensor 57 is inputted to the rotor position detection circuit 64, the rotor position detection circuit 64 detects a rotational phase of the rotor 21, and a signal outputted from the rotor position detection circuit 64 is inputted to the arithmetic unit 60.

The arithmetic unit 60 is a microcomputer including: a central processing unit (CPU) that outputs a drive signal to the inverter circuit 55 based on a processing program and data: a ROM that stores the processing program and control data; and a RAM for temporarily storing data.

A resistance Rs is arranged at a path that supplies power from the storage battery 52 to the inverter circuit 55, and the motor current detection circuit 62 detects, from a voltage drop of the resistance Rs, a current value supplied to the electric motor 16, and outputs a detection signal to the arithmetic unit 60. The battery voltage detection circuit 63 detects a voltage supplied from the storage battery 52 to the inverter circuit 55, and outputs a detection signal to the operation unit 60.

The rotor position detection circuit 64 receives each output signal of the rotor position detection sensors 57, and outputs a position signal of the rotor 21 to the arithmetic unit 60 and the motor rotation speed detection circuit 65. The motor rotation speed detection circuit 65 detects rotation speed of the rotor 21 from the inputted position signal, and outputs a detection result thereof to the arithmetic unit 60.

The voltage of the storage battery 52 is supplied to the entire motor control unit 59 with a predetermined voltage value via a control-circuit voltage supply circuit 69. In addition, the control-circuit voltage detection circuit 66 detects the voltage of the storage battery 52, which is supplied to the motor control unit 59 via the control-circuit voltage supply circuit 69, and outputs a detection result to the arithmetic unit 60.

In addition, a tactile switch 71 is provided to an outer surface of the mounting portion 15, and targeted rotation speed of the electric motor 16 can be set when a worker(s) selects a mode by operating the tactile switch 71. The targeted rotation speed is rotation speed of the rotor 21 per unit time. A mode to set the targeted rotation speed of the electric motor 16 can be switched into three stages, for example, a low-speed mode, a medium-speed mode, and a high-speed mode. The targeted rotation speed set in the medium-speed mode is higher than the targeted rotation speed set in the low-speed mode, and the targeted rotation speed set in the high-speed mode is higher than the targeted rotation speed set in the medium-speed mode. The targeted rotation speed set by the operation of the tactile switch 71 is detected by the switch operation detection circuit 67, and a signal outputted from the switch operation detection circuit 67 is inputted to the arithmetic unit 60. Further, the application voltage setting circuit 68 sets a voltage applied to the electric motor 16 in response to the targeted rotation speed, and inputs a signal to the operation unit 60.

Further, a rotational direction change-over switch 72 is provided, and the worker switches a rotational direction of the electric motor 16 by operating the rotational direction change-over switch 72. A signal outputted from the rotational direction change-over switch 72 is inputted to the arithmetic unit 60. A trigger 73 and a DC speed control switch 74 are provided in the grip 14. The DC speed control switch 74 is turned on or off by the worker operating the trigger 73. A signal to turn on or off the DC speed control switch 74 is inputted to the arithmetic unit 60.

The arithmetic unit 60 obtains: a direction of a current supplied to the coils 23U, 23V and 23W of the electric motor 16, each on/off timing of the switching elements Q1 to Q6 of the inverter circuit 55; and a duty ratio as an on-rate of the switching elements Q1 to Q6 based on signals inputted from various circuits and various switches, and outputs their signals to the control signal output circuit 61.

When the trigger 73 is operated and the DC speed control switch 74 is turned on, the arithmetic unit 60 forms: a drive signal for executing switching control in which the predetermined switching elements Q1 to Q3 perform on and off operations alternately; and a pulse modulation width signal for performing switching control of each of the predetermined switching elements Q4 to Q6 based on a position detection signal of the rotor position detection circuit 64 and outputs the formed signals to the control signal output circuit 61.

The control signal output circuit 61 outputs a switching-element drive signal to a gate of the switching element Q1, a switching-element drive signal to a gate of the switching element Q2, a switching-element drive signal to a gate of the switching element Q3, a pulse width modulation signal to a gate of the switching element Q4, a pulse width modulation signal to a gate of the switching element Q5, and a pulse width modulation signal to a gate of the switching element Q6, based on the drive signal from the arithmetic unit 60. That is, the three switching elements Q1 to Q3 are separately turned on or off by the switching-element drive signal, and the three switching elements Q4 to Q6 are separately turned on or off by the pulse width modulation signal, whereby the duty ratio as the on-rate thereof is controlled.

According to this control, energization to the respective coils 23U, 23V and 23W is alternately performed in a predetermined energization direction, at predetermined energization timing, and in a predetermined period, and the rotor 21 rotates in a targeted rotational direction and at the targeted rotation speed. The targeted rotational direction is set by the worker through the operation of the rotational direction change-over switch 72, and the targeted rotation speed is set by the worker through the operation of the tactile switch 71.

According to the above-described control, each drain or each source of the six switching elements Q1 to Q6 is connected to or cut off from the coils 23U, 23V and 23W which are star-connected. The voltage to be applied to the inverter circuit 55 is supplied to the coil 23U as a voltage Vu corresponding to a U-phase, supplied to the coil 23V as a voltage Vv corresponding to a V-phase, and supplied to the coil 23W as a voltage Vw corresponding to a W-phase. In addition, the arithmetic unit 60 changes a pulse width, that is, the duty ratio of a pulse width modulation (PWM) signal in response to the targeted rotation speed. Incidentally, it is possible to adjust the rotation speed of the rotor 21 if the duty ratio of the PWM signal is changed in response to an operation amount of the trigger 73.

In addition, the arithmetic unit 60 detects actual rotation speed of the rotor 21 based on the signal inputted from the motor rotation speed detection circuit 65. Further, the arithmetic unit 60 controls the duty ratio of the pulse width modulation signal, and executes feedback control to make the actual rotation speed of the rotor 21 approximate to the targeted rotation speed. In the case of changing the actual rotation speed of the rotor 21 by changing the duty ratio, an application voltage set by the application voltage setting circuit 68 is set to be constant. Incidentally, when the operation of the trigger 73 is canceled and the DC speed control switch 74 is turned off, the switching elements Q1 to Q6 of the inverter circuit 55 are constantly turned off, the current is not supplied to the coils 23U, 23V and 23W, and the rotor 21 stops.

In addition, a display unit 70 is provided in the housing 11 or the mounting portion 15, and the display unit 70 is configured by a liquid crystal display or a lamp. A display signal is outputted from the arithmetic unit 60 to the display unit 70. The worker can check the mode of controlling the electric motor 16, the actual rotation speed of the rotor 21, and the voltage of the storage battery 52 by visually confirming the display unit 70.

Here, specifications of components and control examples of the impact tool 10 will be described with reference to FIG. 9. A rated voltage of the storage battery 52 is 18 V regardless of the mode set by the tactile switch 71. Incidentally, a voltage in a fully-charged state of the storage battery 52 is 21.5 V. A duty ratio to control the switching elements Q1 to Q6 of the inverter circuit 55 is set to 90 to 100% in the high-speed mode, 55 to 65% in the medium-speed mode, and 15 to 25% in the low-speed mode. The targeted rotation speed of the rotor 21 is set to 23,000 rpm in the high-speed mode, 14,000 rpm in the medium-speed mode, and 4,000 rpm in the low-speed mode.

Inertia of the hammer 43 is 0.37 kg·cm$^2$ regardless of the mode, both the lead angles θ1 and θ2 are set to 32.00 [deg] regardless of the mode, and a spring constant of the hammer spring 49 is set to 33.54 kgf/cm regardless of the mode. In addition, a length L1 elongated with the protrusion 32 and the protrusion 51 is 3.4 mm as illustrated in FIG. 4(B). The length L1 is a maximum value of a width engaged with the protrusion 32 and the protrusion 51 in the direction along the axis A1.

Next, a use example of the impact tool 10 will be described. When the rotor 21 of the electric motor 16 rotates, a rotational force of the output shaft 17 is transmitted to the sun gear 34 of the decelerator 33. When the rotational force is transmitted to the sun gear 34, the ring gear 35 serves as a reaction force element, and the carrier 37 serves as an output element. That is, when a rotational force of the sun gear 34 is transmitted to the carrier 37, the rotational force is amplified since the rotation speed of the carrier 37 reduced relative to the rotation speed of the sun gear 34. Incidentally, a gear ratio between the sun gear 34 serving as an input element and the carrier 37 serving as the output element is constant in the decelerator 33, and the gear ratio cannot be changed.

When the rotational force is transmitted to the carrier 37, the spindle 40 rotates integrally with the carrier 37, and a rotational force of the spindle 40 is transmitted to the hammer 43 via the cam ball 47. Then, the protrusion 51 and the protrusion 32 are engaged with each other before performing ⅓ rotation from a position at which the hammer 43 starts to rotate, and a rotational force of the hammer 43 is transmitted to the anvil 27. Further, the hammer 43 and the anvil 27 rotate integrally, and a rotational force of the anvil 27 is transmitted to an object via the driver bit 29, and thereby the screw member is tightened.

Thereafter, when the tightening of the screw member is performed and the rotational force required to rotate the anvil 27 increases, the rotation speed of the spindle 40 exceeds the rotation speed of the hammer 43, and the spindle 40 rotates with respect to the hammer 43. The rotational force required to rotate the anvil 27 increases as a thickness or a length of the screw member increases, When the spindle 40 rotates with respect to the hammer 43, the hammer 43 moves in the direction along the axis A1 and in the direction of separating from the anvil 27 against the pressing force of the hammer spring 49 by a reaction force generated at a contact surface between the cam ball 47 and the cam groove 46. A movement of the hammer 43 in the direction of separating from the anvil 27 is referred to as a retreat. When the hammer 43 retreats, a compression load received by the hammer spring 49 increases, and the repulsive force of the hammer spring 49 increases.

When the hammer 43 retreats and the protrusion 51 is separated from the protrusion 32, the rotational force of the hammer 43 is not transmitted to the anvil 27, and the protrusion 51 climbs over the protrusion 32. At a point in time at which the protrusion 51 climbs over the protrusion 32, the pressing force applied to the hammer 43 by the hammer spring 49 exceeds a force in a direction of causing the hammer 43 to retreat. Then, the hammer 43 rotates with respect to the spindle 40, and the hammer 43 moves in the direction of approaching the anvil 27 as the cam ball 47 rolls along the cam grooves 42 and 46. The movement of the hammer 43 in the direction of approaching the anvil 27 is referred to as an advance. Thereafter, the protrusion 51 of the hammer 43 collides the protrusion 32 of the anvil 27, and the striking force in the rotational direction is applied to the anvil 27.

Afterward, the above-described action is repeated during the rotation of the rotor 21, and the tightening work of the screw member by the impact tool 10 is continued. Incidentally, the screw member is loosened if the rotational direction of the electric motor 16 in the rotor 21 becomes opposite to that of the case of tightening the screw member.

The impact tool 10 can change the number of strokes that the protrusion 51 collides with the protrusion 32 during one rotation of the hammer, that is, 360-degree rotation of the hammer 43 with respect to the anvil 27. The number of the protrusions 51 of the hammer 43 is three, the number of the protrusions 32 of the anvil 27 is three, and each of the protrusions 51 strike each of the protrusions 32 at the same time.

Further, as illustrated in FIG. 13(A), if the protrusion 51 of the hammer 43 overpasses the solid-line single protrusion 32 of the anvil 27 when the low-speed mode or the medium-speed mode is selected, the protrusion 51 strikes the broken-line protrusion 32 positioned next to the overpassed protrusion 32. Thus, the number of strokes due to one rotation of the hammer 43 is 3.0 times as illustrated in FIG. 9.

On the other hand, the protrusion 51 of the hammer 43 overpasses the two protrusions 32 of the anvil 27 as illustrated in FIG. 13(B) when the high-speed mode is selected. That is, the protrusion 51 overpasses the struck protrusion 32 indicated by the solid line, and the protrusion 32 indicated by the broken line and positioned next to the struck protrusion 32, and strikes the protrusion 32 indicated by the solid line and positioned in front of the protrusion 32 overpassed in the rotational direction. In this manner, the number of strokes due to one rotation of the hammer 43 is 1.5 times. The number of strokes is a value obtained by multiplying, by ½, three times that is the number of strokes due to two rotations of the hammer 43.

In FIGS. 13(A) and 13(B), a position of the hammer 43 in the rotational direction is illustrated by a horizontal axis, and a position of the hammer 43 in the axis A1 direction is illustrated by a vertical axis. In FIGS. 13(A) and 13(B), both the protrusions 32 and 51 are expressed as quadrangles. In addition, the one-dot chain line is an extension line which expresses a movement trajectory about a rear corner 51*a* of the protrusion 51 in the rotational direction of the hammer 43. In addition, the two-dot chain line is an extension line which expresses a movement trajectory about a front corner 51*b* of the protrusion 51 in the rotational direction of the hammer 43.

When the targeted rotation speed of the rotator 21 is changed like this, the number of strokes is different, and a reason for the difference is as follows. The reason is that the rotation speed of the hammer 43 increases when the actual rotation speed of the rotor 21 increases due to the targeted rotation speed of the rotor 21 being changed. That is, the higher the actual rotation speed of the rotor 21 becomes, the larger becomes a rotation angle in the rotational direction of the hammer 43 from a rotational-direction first position, at which the hammer 43 starts to retreat, to a second position, at which the hammer 43 advances and the protrusions 51 strikes the protrusion 32. The rotation angle of the hammer 43 between the first position and the second position is 60 degrees in the case where the low-speed mode or the medium-speed mode is selected. The rotation angle of the hammer 43 between the first position and the second position is 120 degrees in the case where the high-speed mode is selected. In addition, the higher the rotation speed of the rotor 21 becomes, the stronger the rotational force thereof becomes.

Further, striking energy when the hammer 43 strikes the anvil 27 is determined depending on various conditions, for example, the lead angles θ1 and θ2, the rotational force of the hammer 43, the rotation speed of the hammer 43, the spring constant of the hammer spring 49, and the inertia of the hammer 43. Further, the striking energy increases as the rotation speed of the hammer 43 increases. Accordingly, it is possible to avoid shortage of the striking force, which occurs in the impact tool 10, by changing the targeted rotation speed in response to the rotational force required to tighten the screw member. That is, the striking energy in the case where the high-speed mode is selected becomes greater than the striking energy in the case where the low-speed mode or the medium-speed mode is selected.

Figure 10:
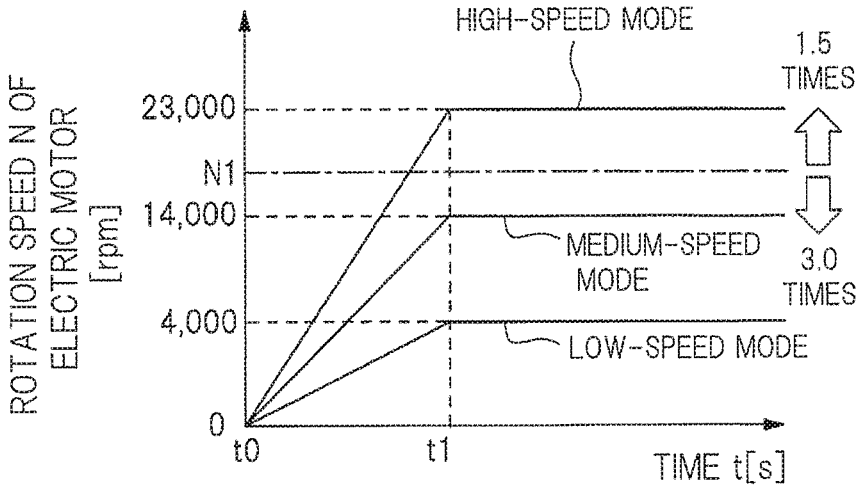
FIG. 10 is a graph illustrating a temporal change of rotation speed of an electric motor which is used in the impact tool according to the present invention.

An example of a temporal change in the rotation speed of the electric motor 16 will be described with reference to FIG. 10. FIG. 10 illustrates an example where the electric motor 16 starts to rotate at a time t0 and the actual rotation speed reaches the targeted rotation speed in each mode at a time t1. The number of strokes when the actual rotation speed of the electric motor 16 is a predetermined value N1 or lower is 3.0 times, and the number of strokes is 1.5 times when the actual rotation speed of the electric motor 16 exceeds the predetermined value N1. The predetermined value N1 is higher than the rotation speed of 14,000 rpm and lower than the rotation speed of 23,000 rpm.

Incidentally, the number of strokes, which has been described with reference to FIGS. 9 and 10, represents that the single protrusion 51 of the hammer 43 strikes the single protrusion 32 of the anvil 27. In this case, if the low-speed mode or the medium-speed mode is selected, the protrusion 51 of the hammer 43 overpasses the single protrusion 32 of the anvil 27, and then strikes the protrusion 32 positioned next to the overpassed protrusion 32. That is, the number of strokes due to the one rotation of the hammer 43 is 3 times. The three times as the number of strokes is a value obtained by multiplying, by ½, six which is the number of strokes due to the two rotations of the hammer 43. That is, the number of strokes due to the one rotation of the hammer 43 is obtained in the present example.

On the other hand, in the case where the high-speed mode is selected, the protrusion 51 of the hammer 43 overpasses the two protrusions 32 of the anvil 27, and then, strikes the protrusion 32 positioned in front of the overpassed protrusion 32 in the rotational direction. That is, the number of strokes due to the one rotation of the hammer 43 is 1.5 times, that is, the number of strokes due to the two rotations of the hammer 43 is 3 times. In addition, regarding the striking force applied from the hammer 43 to the anvil 27, that is, regarding an impact torque in the rotational direction, a case where the number of strokes is 1.5 times is higher than a case where the number of strokes is 3 times. This is because a perimeter until the protrusion 51 collides with the next protrusion 32 after overpassing the protrusion 32 is relatively long. Incidentally, the striking force, and the impact torque described in the present specification mean great rotational forces that are momentarily generated. In addition, the rotational force required to tighten the screw member can be also referred to as a work load.

Control Example 1

Next, Control Example 1 which is executed by the motor control unit 59 will be described with respect to a flowchart of FIG. 11. The motor control unit 59 discriminates the mode, which is set by the worker through the operation of the tactile switch 71, in Step S1. The motor control unit 59 rotates the electric motor 16 when detecting that the trigger 73 is operated and the DC speed control switch 74 is turned on in Step S2. That is, the tightening of the screw member is started.

The motor control unit 59 determines whether the tightening of a bolt or a screw is performed in Step S3. The screw is also referred to as a wood screw. An effective current value detected by the motor current detection circuit 62 differs depending on whether the screw member is the bolt or the screw. This is because a diameter of the bolt is thicker than a diameter of the screw member, and a rotational resistance of the bolt is larger than a rotational resistance of the screw. That is, the effective current value at a time of tightening the bolt is higher than the effective current value at a time of tightening the screw.

Further, it is also possible to discriminate the screw and the bolt based on the effective current value since the effective current value differs depending on conditions other than the diameter of the screw member. For example, a male screw is provided on an outer circumferential surface of the screw, and the screw is fixed to a mating member to which a female screw is not provided. That is, the screw cuts a part of the mating member during its rotation or is bitten into the mating member while causing the mating member to make plastic deformation. On the other hand, the bolt is provided with a male screw on an outer circumferential surface thereof, and the bolt is fixed to a mating member to which a female screw is provided. That is, the bolt rotates while the male screw of the bolt and the female screw of the mating member mesh with each other.

Thus, a work load in a case of tightening the bolt is smaller than a work load in a case of tightening the screw member. In addition, if a spring washer is attached to a shaft portion of the bolt, the rotational force required to rotate the bolt is still larger than that for the screw. In this manner, not only the required rotational force but also the effective current value differs as compared to the screw and the bolt. Incidentally, the mating member to which the bolt is fixed includes: a nut having the female screw; and a structural body in which the female screw is formed. The structural body includes a wall, a floor, a ceiling, a housing, and a bracket.

In addition, the motor control unit 59 performs setting in Step S4 in response to the mode determined in Step S1. The targeted rotation speed of the rotor 21 in each mode is given as illustrated in FIG. 9, and the number of strokes of the anvil 27 by the hammer 43 during the one rotation of the hammer in each mode is given as illustrated in FIG. 9.

Further, the motor control unit 59 can also use a discrimination result in Step S3 in controlling the rotation speed of the electric motor 16 in Step S4. As described above, the effective current value in the case of tightening the bolt is higher than the effective current value in the case of tightening the screw. Thus, there is a possibility that durability of the inverter circuit 55 deteriorates at the time of tightening the bolt. If striking power is suppressed so that the durability of the inverter circuit 55 does not deteriorate due to the tightening of the bolt in order to avoid such inconvenience, there is a possibility that the striking power is insufficient in tightening the screw with a low effective current.

Thus, if the rotation speed of the rotor 21 is controlled in response to the result of the discrimination on whether the screw member is the bolt or the screw in controlling the rotation speed of the rotor 21 at the medium-speed mode or the high-speed mode in Step S4, it is possible to suppress the deterioration of the durability of the inverter circuit 55 at the time of tightening the bolt and to prevent the power shortage of the electric motor 16 in tightening the screw even when the determined mode and a type of the tightened screw member do not fit to each other.

For example, in the high-speed mode in Step S4, it is possible to execute first control in which a rise gradient of the actual rotation speed of the rotor 21 is gentle in tightening the bolt and to execute second control in which the rise gradient of the actual rotation speed of the rotor 21 is rapid in tightening the screw. Meanwhile, it is easy for the worker to use the impact tool 10 complying with a specification of executing the first control. On the contrary, the impact tool 10 complying with a specification of executing the second control enables fast tightening speed of the screw and has high performance as compared to the impact tool 10 complying with the specification of executing the first control.

In addition, the motor control unit 59 performs the following control in Step S5 in the case where the high-speed mode is selected. When the voltage of the storage battery 52 decreases up to a predetermined value or lower in Step S5, the motor control unit 59 sets or changes the targeted rotation speed of the rotor 21 to 14,000 rpm. The predetermined value is a voltage at which a maximum value of feasible rotation speed of the rotor 21 is 23,000 rpm. A reason why the motor control unit 59 performs the control in Step S5 is given as follows.

When the rotation speed of the rotor 21 becomes 21,000 rpm or lower in the case where the high-speed mode is selected, there is a possibility that the protrusion 51 fails to climb over the two protrusions 32 while the hammer 43 rotates once, and that the protrusion 51 contacts a corner portion of the second protrusion 32 to be climbed over. Then, the impact tool 10 vibrates due to impact caused when the protrusion 51 contacts the protrusion 32 to be climbed over, and there is a possibility that operability deteriorates. The rotation speed of the rotor 21 at which the protrusion 51 contacts the second protrusion 32 that to be climbed over is referred to as a striking failure area. Thus, if the targeted rotation speed of the rotor 21 is set to or changed to 14,000 rpm as in Step S5 when the voltage of the storage battery 52 decreases up to the predetermined value or lower, the number of strokes due to the one rotation of the hammer 43 becomes 3.0 times. That is, the protrusion 51 climbs over the protrusions 32 one by one, and it is possible to avoid the contact with the to-be-climbed-over protrusion 32 by the protrusion 51.

Figure 11:
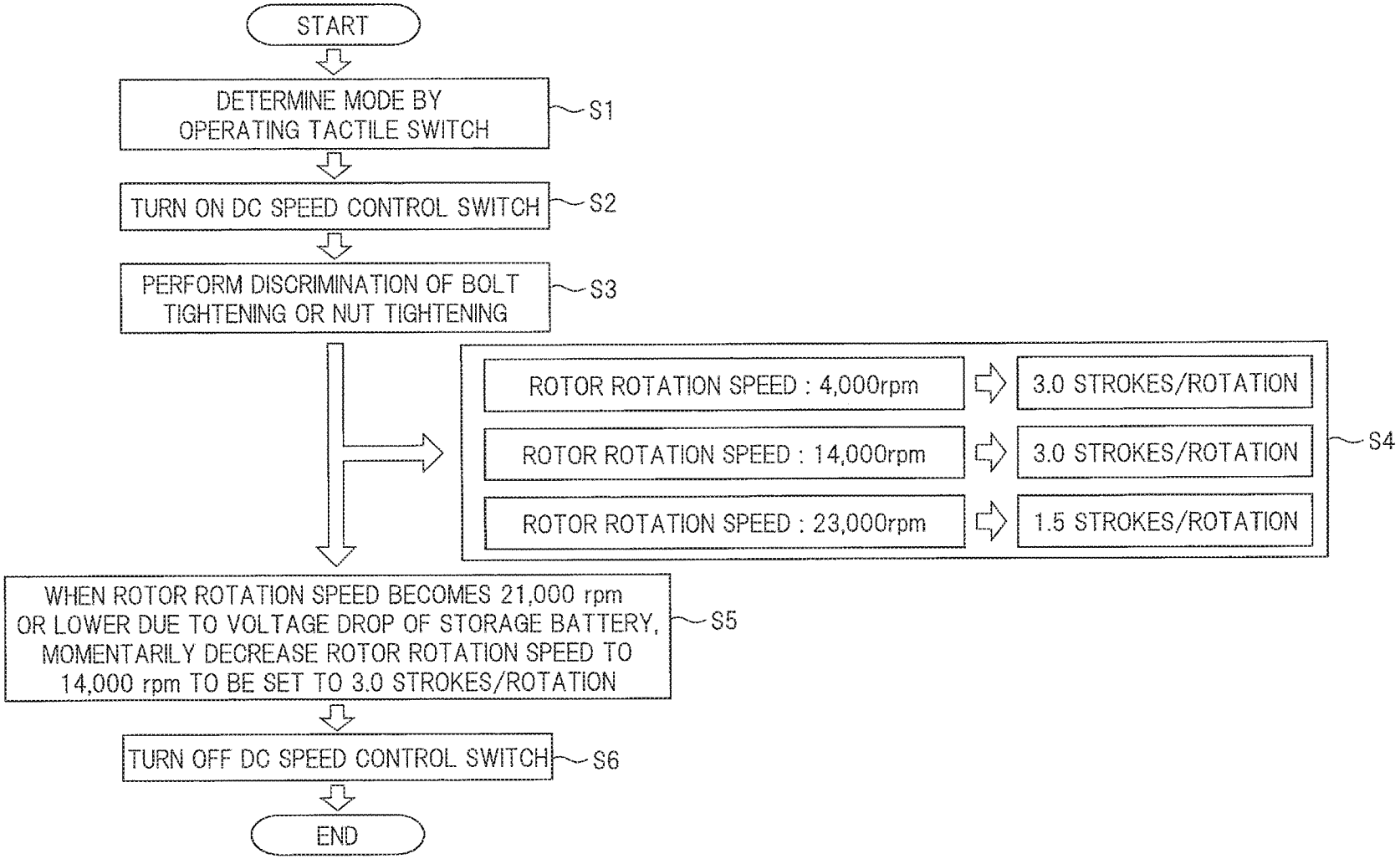
FIG. 11 is a flowchart according to Control Example 1 which can be executed by the impact tool according to the present invention.

When detecting in Step S6 that the operation of the trigger 73 is canceled and the DC speed control switch 74 is turned off, the motor control unit 59 stops the electric motor 16 and ends the flowchart of FIG. 11.

Figure 12:
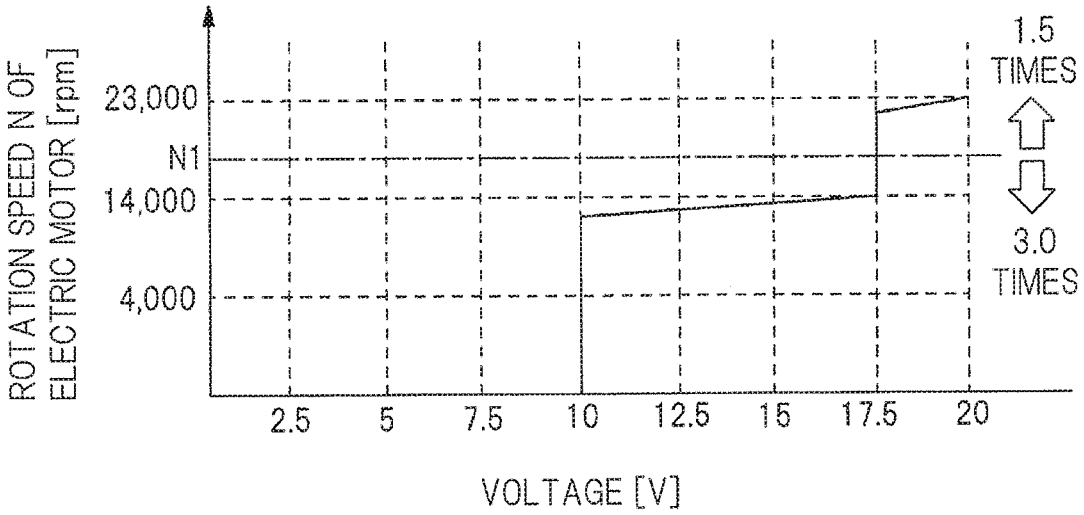
FIG. 12 is a graph illustrating a relationship between the rotation speed of the electric motor and a voltage of the storage battery in the impact tool according to the present invention.

The control in Step S5 will be described with reference to a graph in FIG. 12. The predetermined value used for determination in Step S5 is 17.5 V. Thus, when the voltage decreases to 17.5 V, the rotation speed of the rotor 21 is controlled at 14,000 rpm. Accordingly, since the rotation speed is lowered to 14,000 rpm at 17.5 V which is a voltage to be originally 21,000 rpm as the rotation speed, the duty ratio can be significantly decreased consequently, and so when the voltage of the storage battery 52 is lower than 17.5, there is an advantage of being capable of lengthening time taken until the voltage of the storage battery 52 decreases to 10 V as compared to a range of the voltages of 21.5 V to 18 V. When the voltage becomes 10 V or lower, the storage battery 52 stops and is not capable of rotating the electric motor 16. In addition, when the voltage of the storage battery 52 is lower than 17.5 V, the rotation speed of the rotor 21 becomes low as 14,000 rpm, and the number of strokes due to the one rotation of the hammer 43 becomes 3.0 times. Accordingly, shortened can be the time required from a certain point in time after the tightened start of screw to a point in time of tightening completion of the screw as much as possible.

Further, the impact tool 10 includes the high-speed mode, the medium-speed mode, and the low-speed mode in order to control the rotation speed of the rotor 21. Thus, the worker can also select each mode in response to a length of the screw member regardless of whether the type of the screw member is the screw or the bolt. In this case, the motor control unit 59 may not necessarily perform its determination at Step S3 in FIG. 11 and the control depending on the determination result. For example, when the high-speed mode is selected in tightening a long screw, shortened can be the time required from the tightening start to the tightening completion as much as possible, and the worker can perform the tightening of the screw without stress. In addition, it is also possible to tightening a short screw by selecting the high-speed mode. That is, it brings no problem that the worker uses the high-speed mode regardless of the length of the screw if the switching of the mode is troublesome. When the high-speed mode is selected, however, the rotation speed of the rotor 21 is so high that it is difficult to use the impact tool 10 unless the worker is used to the speed. It is difficult to use the impact tool 10, for example, at a time of performing work etc. of tightening a short screw(s) to be flush with a decorative plate.

On the contrary, in the case of tightening the short screw, the worker, who feels the difficulty of use if selecting the high-speed mode, can switch the high-speed mode to the medium-speed mode. That is, it is possible to select the medium-speed mode in the above-described case where it is difficult to use the impact tool 10 in the high-speed mode. Power of the electric motor 16 in the medium-speed mode is lower than power of the electric motor 16 in the high-speed mode. Thus, since vibration transferred from the impact tool 10 to the worker's hand is low, and the medium-speed mode is lower about the tightening speed of the screw than the high-speed mode, the worker can more easily use the impact tool 10 in the medium-speed mode. Incidentally, the tightening speed of the screw significantly decreases if the rotation speed of the rotor 21 is simply lowered. However, the significant decrease of the tightening speed of the screw is prevented by setting the number of strokes in the medium-speed mode to be larger than that in the high-speed mode in the present invention.

Like this, it is possible to obtain optimal strike timing at two points where the rotation speed of the rotor 21 greatly differs when the three protrusions 51 are provided in the hammer 43, the three protrusions 32 are provided in the anvil 27, the protrusion 51 of the hammer 43 strikes the protrusion 32 after overpassing the one protrusion 32 of the anvil 27 in the low-speed or medium-speed mode, and the protrusion 51 of the hammer 43 strikes the protrusion 32 after overpassing the two protrusions 32 of the anvil 27 in the high-speed mode. The two points mean a point at which the rotation speed of the rotor 21 is 23,000 rpm and a point at which the rotation speed of the rotor 21 is 14,000 rpm.

In addition, the optimal strike timing means that the protrusion 51 of the hammer 43 reliably strikes the predetermined protrusion 32 of the anvil 27 with consequently striking a cam end of the spindle 40 due to an increase of a hammer back amount caused when the too fast rotation speed of the rotor 21, or without consequently falling into a striking failure state such as pre-hit or overshoot due to a decrease of the hammer back amount by the too slow rotation speed of the rotor 21.

In the present embodiment, the lead angles θ1 and θ2 can be arbitrarily set within a range of 24 degrees to 34 degrees. In addition, the motor control unit 59 can arbitrarily set the targeted rotation speed in the high-speed mode within a range of 20,000 rpm to 25,000 rpm. The rotation speed of 25,000 rpm is an upper limit value in the high-speed mode. Further, the motor control unit 59 sets the targeted rotation speed in the medium-speed mode within a range of 11,000 rpm to 14,000 rpm. The targeted rotation speed of 14,000 rpm is an upper limit value in the medium-speed mode.

In addition, when the rotation speed of the rotor 21 is decreased up to 21,000 rpm due to the voltage drop of the storage battery 52 at Step S5 in FIG. 11, the motor control unit 59 can also perform control so that the targeted rotation speed is not kept between a lower limit value in the high-speed mode and the upper limit value in the medium-speed mode for one second or longer. That is, when the rotation speed of the rotor 21 is decreased up to 21,000 rpm, the motor control unit 59 instantly sets or changes the targeted rotation speed to 14,000 rpm.

Control Example 2

Further, the motor control unit 59 can execute Control Example 2 in FIG. 14 in the case of tightening the screw using the impact tool 10. The motor control unit 59 determines whether the voltage of the storage battery 52 is 17 V or higher in Step S11. The voltage to be used for determination in Step S11 is a value set based on the rotor's rotation speed which enables the number of strokes due to the one rotation of the hammer 43 to be 1.5 times. That is, when the rotation speed of the rotor 21 is controlled by applying the voltage of 17 V or higher to the electric motor 16, it is possible to set the number of strokes due to the one rotation of the hammer 43 to be 1.5 times. On the other hand, when the rotation speed of the rotor 21 is controlled by applying the voltage, which is lower than 17 V, to the electric motor 16, there is a possibility that striking failure, that is, a phenomenon in which it is difficult for the hammer 43 to overpass the two protrusions 32 at the same time is caused by power shortage of the electric motor 16.

When it is determined to be "Yes" in Step S11, the motor control unit 59 proceeds to Step S12 and sets the targeted rotation speed of the rotor 21 to be 10,000 rpm in driving the electric motor 16 through the operation of the trigger 73. In addition, the motor control unit 59 sets the duty ratio of the inverter circuit so as to be lower than 60% in Step S12. When the tightening of the screw is performed in a state where the targeted rotation speed of the rotor 21 is set to be 10,000 rpm, the number of strokes due to the one rotation of the hammer 43 is three.

Further, the motor control unit 59 determines in Step S13 whether the effective current value detected by the motor current detection circuit 62 is a first threshold value or higher. The first threshold value is a current value required to keep the actual rotation speed of the rotor 21 at 10,000 rpm of the targeted rotation speed in a case where the tightening of the screw is being performed. When it is determined to be "No" in Step S13, the motor control unit 59 continues the control in Step S12.

When it is determined to be "Yes" in Step S13, the motor control unit 59 proceeds to Step S14, sets the targeted rotation speed of the rotor 21 to 20,000 rpm so as to drive the electric motor 16, and ends the flowchart in FIG. 14. In addition, the motor control unit 59 sets the duty ratio of the inverter circuit so as to be 60% or higher in Step S14. On the other hand, when it is determined to be "No" in Step $11, the motor control unit 59 proceeds to Step S15, sets the targeted rotation speed of the rotor 21 to be 10,000 rpm regardless of the effective current value detected by the motor current detection circuit 62 in driving the electric motor 16 through the operation of the trigger 73, and ends the flowchart in FIG. 14.

FIG. 15 is an example of a time chart which corresponds to Steps S11 to S14 in FIG. 14. The targeted rotation speed of the rotor 21 is set to be 10,000 rpm, and the duty ratio of the inverter circuit is lower than 60% between a time t11 at which the trigger switch is turned on and a time t12. In addition, no stroke due to the one rotation of the hammer is performed between the time t11 and the time t12, and the effective current value is lower than the first threshold value. The number of strokes due to the one rotation of the hammer is set to 3 times after the time t12, but the effective current value is lower than the first threshold value. Thus, the targeted rotation speed of the rotor is set so as to be 10,000 rpm even after the time t12.

When the effective current value becomes the first threshold value or higher at a time t13, the targeted rotation speed of the rotor increases, and the duty ratio that controls the inverter circuit increases to 60% or higher. Incidentally, the hammer rotates a plurality of times and a plurality of strokes are performed between the time t12 and the time t13. It is understood that an execution current value pulsates between the time t12 and the time t13 in FIG. 15. This pulsation of the execution current value is caused by the stroke(s), and the strike(s) is (are) performed the same number of times as the number of pulsations. To be specific, the three strokes are performed. The effective current value becomes low at timing at which the three strokes are performed.

When the targeted rotation speed of the rotor becomes 20,000 rpm at a time t14, an increase rate of the duty ratio that controls the inverter circuit decreases. The number of strokes due to the one rotation of the hammer decreases to 1.5 times from 3 times at the time t14. Incidentally, the rotation speed of the rotor in the electric motor can be changed in response to an operation amount of the trigger 73 after the time t14. That is, it is possible to adjust the rotation speed of the rotor by changing the duty ratio of the PWM signal in response to the operation amount of the trigger 73.

FIG. 16 is an example of a time chart which corresponds to Steps S11 and S15 in FIG. 14. The targeted rotation speed of the rotor 21 is set to be 10,000 rpm and the duty ratio that controls the inverter circuit is controlled to be lower than 100% between a time t21 at which the trigger switch is turned on and a time t22. In addition, no stroke due to the one rotation of the hammer is performed, and the effective current value is lower than the first threshold value. Further, the number of strokes due to the one rotation of the hammer is 3 times after the time t22.

When the effective current value becomes the first threshold value or higher at a time t23, the targeted rotation speed of the rotor does not increase although the duty ratio of the inverter circuit is set to be 60% or higher. In addition, the targeted rotation speed of the rotor is kept at 10,000 rpm even after the time t24.

When the motor control unit 59 executes the control example of FIG. 14 in this manner, the targeted rotation speed of the rotor 21 is set to be 10,000 rpm regardless of the execution current value detected by the motor current detection circuit 62 if the voltage of the storage battery 52 is lower than 17 V, and the number of strokes due to the one rotation of the hammer 43 is kept to be three times. Accordingly, it is possible to avoid the striking failure, that is, the phenomenon in which it is difficult for the hammer 43 to overpass the two protrusions 32 at the same time, and to prevent deterioration in an operation feeling of the worker.

By the motor control unit 59, the targeted rotation speed at a case where the effective current value is the first threshold value or higher and is lower than a second threshold value is set to be higher than the targeted rotation speed at a case where the effective current value is lower than the first threshold value. Accordingly, the tightening speed of the screw at the case where the effective current value is the first threshold value or higher and is lower than the second threshold value can be set to be higher than the tightening speed at the screw of the case where the effective current value is lower than the first threshold value. In addition, shortened can be the time required between the tightening start of the screw and the tightening completion of the screw.

Further, the rotation speed of the driver bit 29 before the hammer 43 starts the operation of striking the anvil 27 is lower than the rotation speed of the driver bit 29 after the hammer 43 starts the operation of striking the anvil 27. Accordingly, it is possible to suppress cam-out of the driver bit 29 before the hammer 43 starts the operation of striking the anvil 27.

Control Example 3

Further, the motor control unit 59 can execute Control Example 3 in FIG. 17 in the case of tightening the bolt or the screw using the impact tool 10. When the trigger 73 is operated, the motor control unit 59 sets the targeted rotation speed of the rotor 21 to be 10,000 rpm in Step S21 and drives the electric motor 16. In addition, the motor control unit 59 sets the duty ratio to be lower than 60%. When the tightening of the screw member is performed in the state where the targeted rotation speed of the rotor 21 is set to be 10,000 rpm, the number of strokes due to the one rotation of the hammer 43 is three. The control in Step S21 is the same as the control in Step S12.

Further, the motor control unit 59 determines in Step S22 whether the effective current value detected by the motor current detection circuit 62 is the first threshold value or higher. The meaning of determination performed in Step S22 is the same as the meaning of determination in Step S13. When it is determined to be "No" in Step S22, the motor control unit 59 continues the control in Step S21.

When it is determined to be "Yes" in Step S22, the motor control unit 59 proceeds to step S23 and determines whether the effective current value detected by the motor current detection circuit 62 is the second threshold value or higher. The second threshold value is a value for determining whether the tightening screw member is the bolt, and the second threshold value is higher than the first threshold value. For example, an execution current value in a case where the compression load is applied to the spring washer in the midst of tightening the bolt is higher than an effective current value in the case of tightening the screw. A work load in the case of an effective current value that is the second threshold value or higher is larger than a work load in the case of an effective current value that is the first threshold value or higher and lower than the second threshold value. The motor control unit 59 determines that the screw is tightened when an effective flow value is lower than the second threshold value, and determines that the bolt is tightened when the effective current value is the second threshold value or higher.

When it is determined to be "No" in Step S23, the motor control unit 59 executes the control in Step S24. The motor control unit 59 sets the targeted rotation speed of the rotor 21 to be 10,000 rpm and drives the electric motor 16 in Step S24. In addition, the motor control unit 59 sets the duty ratio in executing the control in Step S24 to be 80%.

After executing the control in Step S24, the motor control unit 59 determines in Step S25 whether the effective current value detected by the motor current detection circuit 62 is the second threshold value or higher. The meaning of determination in Step S25 is the same as the meaning of determination in Step S23. When it is determined to be "No" in Step S25, the motor control unit 59 continues the control in Step S24.

When it is determined to be "Yes" in Step S25, the motor control unit 59 proceeds to step S26 and determines whether the effective current value detected by the motor current detection circuit 62 is a third threshold value or higher. The third threshold value is a value for determining whether a process of tightening the bolt approaches its completion, and the third threshold value is higher than the second threshold value. For example, an effective current value in a case where a reaction force generated by compression of the spring washer approaches a maximum value becomes higher than an effective current value at a point in time at which the compression of the spring washer is started. That is, a work load as an effective current value which is the third threshold value or higher is larger than a work load as an effective current value which is the second threshold value or higher and lower than the third threshold value.

When it is determined to be "No" in Step S26, the motor control unit 59 proceeds to Step S27, and sets the targeted rotation speed of the rotor 21 to be 10,000 rpm and the duty ratio to be 60% in driving the electric motor 16. During the execution of the control in Step S27, the motor control unit 59 determines in Step S28 whether the effective current value detected by the motor current detection circuit 62 is the third threshold value or higher. The meaning of determination in Step S28 is the same as the meaning of determination in Step S26.

When it is determined to be "No" in Step S28, the motor control unit 59 continues the control in Step S27. When it is determined to be "Yes" in Step S28, the motor control unit 59 proceeds to Step S29, sets the targeted rotation speed of the rotor 21 to be lower than 10,000 rpm and the duty ratio at 30% so as to drive the electric motor 16, and ends the control example in FIG. 17. In addition, when it is determined to be "Yes" in Step S26, the motor control unit 59 proceeds to Step S29.

Further, when it is determined to be "Yes" in Step S23, the motor control unit 59 determines in Step S30 whether the effective current value detected by the motor current detection circuit 62 is the third threshold value or higher. The meaning of determination in Step S30 is the same as the meaning of determination in Step S26. The motor control unit 59 proceeds to Step S27 when it is determined to be "No" in Step S30, and proceeds to Step S29 when it is determined to be "Yes" in Step S30.

FIG. 18 is an example of a time chart which corresponds to Control Example 3 of FIG. 17. The motor control unit 59 sets the targeted rotation speed of the rotor 21 to be 10,000 rpm between a time t31 at which the trigger switch is turned on and a time t32. No stroke due to the one rotation of the hammer is performed between the time t31 and the time t32, and the effective current value is lower than the first threshold value. In addition, the motor control unit 59 controls the duty ratio to be 30% or higher and lower than 60%. The number of strokes due to the one rotation of the hammer becomes 3 times at the time t32, but the motor control unit 59 keeps the targeted rotation speed of the rotor at 10,000 rpm since the effective current value is lower than the first threshold value.

When the effective current value becomes the first threshold value or higher at a time t33, the motor control unit 59 controls the duty ratio, which controls the inverter circuit, to be 60% or higher and increases the targeted rotation speed of the rotor. Incidentally, the hammer rotates a plurality of times between the time t32 and the time t33, and a plurality of strokes are performed. It is understood that an execution current value pulsates between the time t32 and the time t33 in FIG. 18. This pulsation of the execution current value is caused by the stroke(s), and the stroke(s) is (are) performed the same number of times as the number of pulsations. To be specific, the strike is performed three times. The stroke(s) is (are) performed at timing at which the effective current value becomes low. The motor control unit 59 sets the targeted rotation speed of the rotor to be 20,000 rpm and the duty ratio, which controls the inverter circuit, to be 80% at a time t34. The number of strokes due to the one rotation of the hammer decreases to 1.5 times from 3 times at the time t34.

When the effective current value is the second threshold value or higher at a time t35, the motor control unit 59 changes the duty ratio from 80% to 60% and sets the targeted rotation speed of the rotor to be 10,000 rpm. The number of strokes due to the one rotation of the hammer increases to 3 times from 1.5 times at the time t35.

Further, when the effective current value becomes the third threshold value or higher at a time t36, the motor control unit 59 changes the duty ratio from 60% to 30% and sets the targeted rotation speed of the rotor to be lower than 10,000 rpm. Thus, the effective current value becomes lower than the first threshold value after the time t36. Incidentally, the number of strokes due to the one rotation of the hammer is 3 times even after the time t36.

By the motor control unit 59, the targeted rotation speed at a case where the effective current value is the first threshold value or higher and is lower than the second threshold value is set to be higher than the targeted rotation speed at a case where the effective current value is lower than the first threshold value even in Control Example 3. Accordingly, the tightening speed of the bolt of the case where the effective current value is the first threshold value or higher and is lower than the second threshold value can be set to be higher than the tightening speed of the bolt of the case where the effective current value is lower than the first threshold value. In addition, shortened can be the time required between the tightening start of the bolt and the tightening completion of the bolt as much as possible.

In addition, when the effective current value is changed to the second threshold value or higher from the value lower than the second threshold value, the motor control unit 59 decreases the targeted rotation speed of the rotor 21 from 20,000 rpm to 10,000 rpm. Thus, the number of strokes due to the one rotation of the hammer 43 is switched to 3 times from 1.5 times. Accordingly, it is possible to prevent the striking force applied from the hammer 43 to the anvil 27 from being excessively greater than the work load in a state where the tightening of the bolt approaches the completion. Accordingly, it is possible to reduce damage that the hammer 43 and the anvil 27 receive and to protect the hammer 43 and the anvil 27. In Control Example 3, the same effect (s) as that (those) of Control Example 2 is (are) obtained in the step of executing the same process as that of Control Example 2.

FIGS. 19(A) and 19(B) are trajectories when the hammer 43 strikes the anvil 27. FIG. 19(A) is the trajectory of a case where the hammer 43 strikes the protrusion 32, three times, while rotating once. The hammer 43 sequentially strikes the protrusions 32 one by one. FIG. 19(B) is the trajectory of a case where the hammer 43 strikes the protrusion 32, 1.5 times, while rotating once. The hammer 43 strikes the protrusion 32 every other protrusion.

In Control Example 2 and Control Example 3, a method of changing the rotation speed of the electric motor 16 by the motor control unit 59 may be a method of changing the voltage applied to the electric motor 16 instead of a method of changing the duty ratio of the inverter circuit while keeping the constant voltage. In this case, the actual rotation speed of the electric motor increases in proportion to an increase of the voltage applied to the electric motor. For example, a voltage applied to the electric motor 16 at Step S14 in FIG. 14 is set to be higher than a voltage applied to the electric motor 16 at Step S12 in FIG. 14.

In addition, a voltage applied to the electric motor 16 at Step S24 in FIG. 17 is set to be higher than a voltage applied to the electric motor 16 at Step S21 in FIG. 17. Further, a voltage applied to the electric motor 16 at Step S27 in FIG. 17 is set to be lower than a voltage applied to the electric motor 16 at Step S24 in FIG. 17. Further, a voltage applied to the electric motor 16 at Step S29 in FIG. 17 is set to be lower than a voltage applied to the electric motor 16 at Step S27 in FIG. 17.

A correspondence relation between the items described in the embodiment and a configuration of the present invention is as follows. The anvil 27 corresponds to a tool support member according to the present invention, the hammer 43 corresponds to a hammer according to the present invention, the impact tool 10 corresponds to an impact tool according to the present invention, the spindle 40 corresponds to a rotating member according to the present invention, the motor control unit 59 and the inverter circuit 55 correspond to a control unit according to the present invention, the low-speed mode and the medium-speed mode correspond to a first rotation mode and a first state according to the present invention, and the high-speed mode corresponds to a second rotation mode and a second state according to the present invention.

In addition, the three protrusions 51 correspond to a plurality of first engaging portions and three first engaging portions according to the present invention, and the three protrusions 32 correspond to a plurality of second engaging portions and three second engaging portions according to the present invention. The cam groove 42 corresponds to a first cam groove according to the present invention, the cam groove 46 corresponds to a second cam groove according to the present invention, the cam ball 47 corresponds to a rolling element according to the present invention, the hammer spring 49 corresponds to a biasing member according to the present invention, the electric motor 16 corresponds to an electric motor according to the present invention, the housing 11 corresponds to a housing according to the present invention, the stator 20 corresponds to a stator according to the present invention, the rotor 21 corresponds to a rotor according to the present invention, and the coils 23U, 23V and 23W correspond to a coil according to the present invention.

Further, the inverter circuit 55 corresponds to an inverter circuit according to the present invention, the switching elements Q1 to Q6 correspond to a switching element according to the present invention, the tactile switch 71 corresponds to a rotation speed setting mechanism according to the present invention, the storage battery 52 corresponds to a DC power supply according to the present invention, the rotation speed of 4,000 rpm corresponds to first targeted rotation speed according to the present invention, the rotation speed of 14,000 rpm corresponds to second targeted rotation speed according to the present invention, and the rotation speed of 20,000 to 25,000 rpm corresponds to third targeted rotation speed according to the present invention. In addition, the rotation speed of 4,000 rpm and 14,000 rpm corresponds to first rotation speed according to the present invention, and the rotation speed of 20,000 to 25,000 rpm corresponds to second rotation speed according to the present invention. The inclined edges 42A and 42B correspond to a first inclined edge according to the present invention, the inclined edges 46C and 46D correspond to a second inclined edge according to the present invention, the straight lines B1 and C1 correspond to a straight line according to the present invention, the lead angle θ1 corresponds to a first inclination angle according to the present invention, the lead angle θ2 corresponds to a second inclination angle according to the present invention, and the rotation angles of 60 degrees and 120 degrees correspond to a predetermined angle according to the present invention.

The present invention is not limited to the above-described embodiment, and it is a matter of course that various modifications can be made in a range without departing from a gist thereof. For example, the work tool includes a driver bit tightening a screw as the screw member, and a driver bit having a concave portion into which a head portion of a bolt as the screw member is inserted. The driver bit having the concave portion is also referred to as a socket or a box. In addition, the work tool includes a structure of rotating a nut with a female screw and fixing it to a bolt with a male screw. In this case, the work tool includes a concave portion containing the nut. That is, the screw members rotated by the work tool include the bolt, the screw, and the nut. The nut may be a nut to which the spring washer is attached. Further, the work tool includes a drill bit drilling a hole in wood, concrete or the like. The first engaging portion and the second engaging portion according to the present invention are engaged with each other and transmit the rotational force. The first engaging portion includes a protrusion which protrudes from the hammer in the axial direction or a protrusion which protrudes from the hammer in the radial direction. The second engaging portion includes a protrusion which protrudes from the tool support member in the axial direction or a protrusion, which protrudes from the tool support member in the radial direction.

In addition, it is also possible to provide a transmission, which is capable of changing a gear ratio between the input element and the output element in a stepwise or stepless manner, instead of the decelerator. In this case, a gear ratio change-over switch is provided in the housing, and the worker changes the gear ratio of the transmission by operating the gear ratio change-over switch. Further, it is possible to change the rotation speed of the spindle by controlling the gear ratio of the transmission. The gear ratio change-over switch corresponds to the control unit according to the present invention. That is, the control unit according to the present invention includes: a control unit which controls the rotation speed of the motor to control the rotation speed of the rotating member; and a control unit which changes the gear ratio of the transmission to control the rotation speed of the rotating member. In addition, the speed-up of tightening of the screw member includes an increase in the rotation speed of the screw member, and shortening of the time required between the tightening start of the screw member and the tightening completion as much as possible.

Further, the power supply that supplies the current to the electric motor includes an AC power supply in addition to the DC power supply such as the storage battery. When the AC power supply is used as the power supply, the electric motor and the AC power supply are connected via a power cable. Further, it is also possible to use a brush-equipped electric motor as the electric motor instead of the brushless electric motor. The rotation speed setting mechanism according to the present invention includes a switch or a button pushed and operated by the worker, a lever capable of reciprocating motion, a knob capable of rotating motion, and a touch switch provided in a liquid crystal display. The rotating member according to the present invention is an element that transmits the rotational force of the motor to the tool support member, and the rotating member includes a spindle, a gear, a pulley, and a carrier of a planetary gear mechanism.

The motor according to the present invention includes a hydraulic motor, a pneumatic motor, and an internal combustion engine in addition to the electric motor. The internal combustion engine can change the rotation speed of the output shaft by controlling an intake air amount. The hydraulic motor can change the rotation speed of the output shaft by controlling hydraulic pressure inside a hydraulic chamber. The pneumatic motor can change the rotation speed of the output shaft by controlling a feed rate of air. The biasing member according to the present invention includes an elastic body made of metal, for example, a coil spring.

REFERENCE NUMERALS LIST

10 . . . impact tool; 11 . . . housing; 16 . . . electric motor; 20 . . . stator; 21 . . . rotor; 23U, 23V, 23W . . . coil; 27 . . . anvil; 32, 51 . . . protrusion; 40 . . . spindle; 42, 46 . . . cam groove; 42A, 42B, 46C, 46D . . . inclined edge; 43 . . . hammer; 47 . . . cam ball; 49 . . . hammer spring; 52 . . . storage battery; 55 . . . inverter circuit; 59 . . . motor control unit; . . . 71 . . . tactile switch; B1, C1 . . . straight line; Q1 to Q6 . . . switching element; and θ1, θ2 . . . lead angle.

The invention claimed is:

1. An impact tool comprising:

a motor;

a tool support member which supports a work tool and is driven by the motor;

a hammer which applies a striking force in a rotational direction to the tool support member;

a rotating member which is arranged to be concentric with the tool support member, supports the hammer to be movable in an axial direction and the rotational direction with respect to the tool support member, and transmits motive power of the motor to the tool support member;

a switch member that sets rotation speed of the motor; and a control unit which controls rotation speed of the motor or the rotating member, wherein the hammer includes a plurality of first engaging portions, wherein the tool support member includes a plurality of second engaging portions, and wherein a number of times the hammer strikes the tool support member while the hammer rotates a single rotation with respect the tool support is adjusted based on the rotation speed of the motor or the rotating member and based on the number of the plurality of second engaging portions overpassed by one of the plurality of first engaging portions.

2. The impact tool according to claim 1, wherein the plurality of first engaging portions includes three first engaging portions which are mutually arranged at an equal angle in the rotational direction, and the plurality of second engaging portions includes three second engaging portions which are mutually arranged at an equal angle in the rotational direction and are struck separately by the three first engaging portions.

3. The impact tool according to claim 1, wherein the impact tool is provided with a housing which contains the motor, the motor is a brushless electric motor comprising:

a stator fixed to the housing and having a coil to which a current is supplied; and a rotor which rotates when the current is supplied to the stator, the impact tool comprises:

an inverter circuit which supplies the current to the coil;

the switch member that receives an input for setting rotation speed of the motor; and the control unit controls the rotation speed of the motor by controlling a switching element of the inverter circuit in response to an operation of the rotation speed setting mechanism.

4. The impact tool according to claim 3, wherein the control unit controls the rotation speed of the motor in response to any of:

a low-speed mode in which the rotation speed is set to first targeted rotation speed as the rotation speed of the motor;

a medium-speed mode in which the rotation speed is set to second targeted rotation speed higher than the first targeted rotation speed as the rotation speed of the motor; and a high-speed mode in which the rotation speed is set to third targeted rotation speed higher than the second targeted rotation speed as the rotation speed of the motor.

5. The impact tool according to claim 4, wherein the impact tool is provided with a DC power supply which supplies a current to the motor, and the control unit sets the rotation speed of the motor to be any of the low-speed mode or the medium-speed mode when a voltage of the DC power supply is a predetermined value or lower.

6. The impact tool according to claim 5, wherein the control unit executes:

control of setting a lower limit value and an upper limit value of the second targeted rotation speed and setting a lower limit value and an upper limit value of the third targeted rotation speed; and control of performing, within one second, control to set the rotation speed of the motor between the lower limit value of the second targeted rotation speed and the upper limit value of the third targeted rotation speed when the voltage of the DC power supply is the predetermined value or lower.

7. The impact tool according to claim 1, wherein the rotating member is provided with a first cam groove in an outer circumferential surface, the hammer has an annular shape and is provided with a second cam groove in an inner circumferential surface, a rolling element held by the first cam groove and the second cam groove is provided, the hammer is movable in the axial direction and the rotational direction with respect to the tool support member by the rolling element rolling inside the first cam groove and the second cam groove, a biasing member, which biases the hammer in the axial direction and in a direction of approaching the tool support member, is provided, the first cam groove has a first inclined edge which is inclined with respect to the axial direction, the second cam groove has a second inclined edge which is inclined with respect to the axial direction, and both a first inclination angle on an acute angle side, which is formed between a straight line intersecting the axial direction and the first inclined edge, and a second inclination angle on an acute angle side, which is formed between the straight line and the second inclined edge, are set in a range of 24 degrees to 34 degrees.

8. The impact tool according to claim 1, wherein the motor is an electric motor which generates motive power when a voltage is applied, the control unit changes a number of strokes of the tool member due to one rotation of the hammer, and the control unit increases the rotation speed of the rotating member by controlling the voltage applied to the electric motor after the hammer starts an operation of striking the tool support member, and decreases the number of strokes of the tool member due to the one rotation of the hammer.

9. The impact tool according to claim 1, wherein the motor is an electric motor which generates motive power when a voltage is applied, the control unit changes a number of strokes of the tool member due to the one rotation of the hammer, and the control unit decreases the rotation speed of the rotating member by controlling the voltage applied to the electric motor after the hammer starts the operation of striking the tool support member, and increases the number of strokes of the tool member due to the one rotation of the hammer.

* * * * *